US006987499B2

(12) United States Patent
Yamaguchi et al.

(10) Patent No.: US 6,987,499 B2
(45) Date of Patent: Jan. 17, 2006

(54) METHOD FOR DRIVING LIQUID CRYSTAL DISPLAY, LIQUID CRYSTAL DISPLAY DEVICE AND MONITOR PROVIDED WITH THE SAME

(75) Inventors: Hisashi Yamaguchi, Tokyo (JP); Takashi Yazaki, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 327 days.

(21) Appl. No.: 10/184,910

(22) Filed: Jul. 1, 2002

(65) Prior Publication Data

US 2003/0001810 A1 Jan. 2, 2003

(30) Foreign Application Priority Data

Jun. 29, 2001 (JP) ..... 2001-200095

(51) Int. Cl.
*G09G 3/36* (2006.01)
*H04N 5/202* (2006.01)

(52) U.S. Cl. ..... 345/89; 345/690; 348/674

(58) Field of Classification Search ..... 345/204–206, 345/690–693, 87–103; 348/671, 674
See application file for complete search history.

(56) References Cited

U.S. PATENT DOCUMENTS 5,621,426 A * 4/1997 Okada et al. ..... 345/95
5,764,216 A * 6/1998 Tanaka et al. ..... 345/87
6,031,629 A * 2/2000 Shibuya et al. ..... 358/1.9
6,300,931 B1 * 10/2001 Someya et al. ..... 345/102
6,353,435 B2 * 3/2002 Kudo et al. ..... 345/204
6,404,512 B1 * 6/2002 Tone ..... 358/3.01
6,597,371 B2 * 7/2003 Mandl ..... 345/691
2002/0145602 A1 * 10/2002 Matsueda ..... 345/213
2002/0158862 A1 * 10/2002 Chen et al. ..... 345/211

FOREIGN PATENT DOCUMENTS

| | | | |
|---|---|---|---|
| JP | 02-285391 | | 11/1990 |
| JP | 05-249436 | | 9/1993 |
| JP | 06006733 A | * | 1/1994 |
| JP | 11-126052 | | 5/1999 |
| JP | 2000184236 A | * | 6/2000 |
| JP | 2001-134242 | | 5/2001 |
| KR | 1998-042281 | | 8/1998 |
| KR | 1999-0025691 | | 7/1999 |

OTHER PUBLICATIONS

Korean Office Action dated Jan. 21, 2005 (with partial English translation).

* cited by examiner

*Primary Examiner*—Alexander Eisen
(74) *Attorney, Agent, or Firm*—MGinn & Gibb, PLLC

(57) ABSTRACT

A method is provided for driving a liquid crystal display capable of preventing degradation of linearity of a gamma characteristic, of achieving display of a high quality image in a simple and low-priced configuration and of solving problems associated with environmental changes, frequency characteristic of timing signals, change in a gamma characteristic caused by luminance of a backlight, or dispersion in a gamma characteristic occurring during processes of manufacturing a color liquid crystal display. The method includes acquirement of first corrected red data, first corrected green data, and first corrected blue data each being of 10 bits to which information to change a gray scale two or more times for every red data, green data, and blue data has been added when a gamma correction is made to red, green, and blue data each being of 8 bits and generation of data red, green, and blue signals to be fed to a data electrode of a liquid crystal display to perform frame rate control.

22 Claims, 12 Drawing Sheets

*FIG.2*

| correcting pattern | address | | data |
|---|---|---|---|
| | A12~A10 | A9~A0 | D9~D0 |
| pattern 1 | 0 | 0 | corrected data of red 0 gray levels |
| | | 1 | corrected data of red 1 gray level |
| | | ⋮ | ⋮ |
| | | 255 | corrected data of red 255 gray levels |
| | | 256 | corrected data of green 0 gray levels |
| | | ⋮ | ⋮ |
| | | 511 | corrected data of green 255 gray levels |
| | | 512 | corrected data of blue 0 gray levels |
| | | ⋮ | ⋮ |
| | | 767 | corrected data of blue 255 gray levels |
| pattern 2 | 1 | 0 | corrected data of red 0 gray levels |
| | | 1 | corrected data of red 1 gray level |
| | | ⋮ | ⋮ |
| | | 255 | corrected data of red 255 gray levels |
| | | 256 | corrected data of green 0 gray levels |
| | | ⋮ | ⋮ |
| | | 511 | corrected data of green 255 gray levels |
| | | 512 | corrected data of blue 0 gray levels |
| | | ⋮ | ⋮ |
| | | 767 | corrected data of blue 255 gray levels |
| ⋮ | ⋮ | ⋮ | ⋮ |
| pattern 8 | 7 | 0 | corrected data of red 0 gray levels |
| | | 1 | corrected data of red 1 gray level |
| | | ⋮ | ⋮ |
| | | 255 | corrected data of red 255 gray levels |
| | | 256 | corrected data of green 0 gray levels |
| | | ⋮ | ⋮ |
| | | 511 | corrected data of green 255 gray levels |
| | | 512 | corrected data of blue 0 gray levels |
| | | ⋮ | ⋮ |
| | | 767 | corrected data of blue 255 gray levels |

*FIG.5*

| B9 | B8 | B7 | B6 | B5 | B4 | B3 | B2 | B1 | B0 |
|---|---|---|---|---|---|---|---|---|---|
| D9 | D8 | D7 | D6 | D5 | D4 | D3 | D2 | D1 | D0 |

*FIG.6*

| *first corrected data* | | | *gray-scale display* | | | | | |
|---|---|---|---|---|---|---|---|---|
| *high-order 8bits* | *low-order 2bits* | | *first frame* | *second frame* | *third frame* | *fourth frame* | *fifth frame* | |
| D9~D2 | D1 | D0 | | | | | | |
| a | 0 | 0 | a | a | a | a | a | ... |
| a | 0 | 1 | a | a | a | a+1 | a | ... |
| a | 1 | 0 | a | a | a+1 | a+1 | a | ... |
| a | 1 | 1 | a | a+1 | a+1 | a+1 | a | ... |

METHOD FOR DRIVING LIQUID CRYSTAL DISPLAY, LIQUID CRYSTAL DISPLAY DEVICE AND MONITOR PROVIDED WITH THE SAME

BACKGROUND OF THE INVENTION

1. Field of the Invention

The present invention relates to a method for driving a liquid crystal display being used as a monitor for a personal computer, a TV (television) set or a like, a liquid crystal display device and a monitor provided with the same, and more particularly to the method for driving a liquid crystal display to display a gray shade by placing light and shade to a character, image, or a mike, in a step-by-step manner and the liquid crystal display device employing the above method for driving a liquid crystal display and the monitor being provided with such the liquid crystal display device described above.

The present application claims priority of Japanese Patent Application No.2001-200095 filed on Jun. 29, 2001, which is hereby incorporated by reference.

2. Description of the Related Art

FIG. 13 is a block diagram showing an example of configurations of a conventional liquid crystal display device disclosed in Japanese Patent Application Laid-open No. 2001-134242. As shown in FIG. 13, the conventional liquid crystal display device 1 includes a color liquid crystal display 1, a control circuit 2, a gray-scale power circuit 3, a data electrode driving circuit 4, and a scanning electrode driving circuit 5.

The color liquid crystal display 1 uses, for example, an active-matrix driving type color liquid crystal display employing a thin-film transistor (TFT) as a switching element. In the color liquid crystal display 1, a region surrounded by a plurality of scanning electrodes (gate lines) arranged at specified intervals in a row direction and by a plurality of data electrodes (source lines) arranged at specified intervals in a column direction is used as a pixel. In the color liquid crystal display 1, a liquid crystal cell being equivalently a capacitive load, a common electrode, a TFT used to drive a corresponding liquid crystal cell, and a capacitor used to accumulate a data electrode during one vertical sync period are arranged for each pixel. To drive the color liquid crystal display 1, while a common potential $V_{com}$ is being applied to a common electrode, a data red signal, a data green signal, and a data blue signal produced based on red data $D_R$, green data $D_G$, and blue data $D_B$ each being digital video data are fed to data electrodes, while a scanning signal produced based on a horizontal sync signal $S_H$, vertical sync signal $S_V$, or a like is fed to scanning electrodes. This causes color characters or images to be displayed on a display screen of the color liquid crystal display 1. The color liquid crystal display 1 is of an SXGA (Super Extended Graphics Array)—type liquid crystal display with 1280-by-1024 pixel resolution.

The control circuit 2 is made up of, for example, an ASIC (Application Specific Integrated Circuit) and, as shown in FIG. 14, has a control section 6 and gamma correcting sections $\mathbf{7}_1$ to $\mathbf{7}_3$. The control section 6 generates a horizontal scanning pulse $P_H$, a vertical scanning pulse $P_V$, and a polarity reversing pulse POL used to drive the Color liquid crystal display 1 with alternating current and feeds them to the data electrode driving circuit 4 and the scanning electrode driving circuit 5. Moreover, the control section 6 feeds control signals $S_{CR}$, $S_{CG}$, and $S_{CB}$ used to control the gamma correcting sections $\mathbf{7}_1$ to $\mathbf{7}_3$ to gamma correcting sections $\mathbf{7}_1$ to $\mathbf{7}_3$. The gamma correcting sections $\mathbf{7}_1$ to $\mathbf{7}_3$ provide a gray shade by making a gamma correction individually to each of the red data $D_R$, green data $D_G$, and blue data $D_B$ each being of 8 bits and being fed from an external by arithmetic operations based on control signals $S_{CR}$, $S_{CG}$, and $S_{CB}$ to be fed from the control section 6. The gamma correcting sections $\mathbf{7}_1$ to $\mathbf{7}_3$ feed results from the gamma correction to the data electrode driving circuit 4 as corrected red data $D_{RG}$, corrected green data $D_{GG}$, and corrected blue data $D_{BG}$.

Next, a gamma correction is described. A reproduction characteristic is expressed by plotting a logarithmic value of luminance that a subject of, for example, a landscape, person or a like appearing in a photograph taken by a video camera originally has, as abscissa, and by plotting a logarithmic value of luminance of a reproduced image displayed by a video signal fed from a video camera as ordinate and, when an angle of inclination of a curve of the above reproduction characteristic is given as "θ", a value of tan θ is defined as a gamma (γ). When luminance of a subject is faithfully reproduced on a display, that is, when the logarithmic value (input value) plotted as abscissa increases or decreases by 1 (one), the logarithmic value (output value) plotted as ordinate increases or decreases by 1 (one), a curve for the reproduction characteristic proves to be a linear line having an angle of inclination θ of 45° and, since tan 45°=1, the gamma becomes 1 (one). Therefore, to faithfully reproduce luminance of a subject, it is necessary that a gamma of a whole system including an imaging device making up a video camera used to take a picture of a subject to a CRT (Cathode Ray Tube) display used to reproduce an image is 1 (one). However, each of imaging devices such as a CCD (Charged Coupled Device) or a like making up a video camera and each of CRT displays have their own specific gamma. For example, a gamma of the CCD is 1 and a gamma of the CRT display is about 2.2. Thus, in order to have a gamma of a whole system become 1 (one) and to obtain a reproduction image providing a good gray shade, a correction of an image signal is required, and this correction is referred to as a "gamma correction". In ordinary cases, a gamma correction is made to a video signal so that the image signal can be matched to a characteristic (gamma characteristic) of a CRT display.

The gamma correction to be made by the gamma correcting sections $\mathbf{7}_1$ to $\mathbf{7}_3$ includes a first gamma correction and a second gamma fine correction used to correct a difference among a red color, a green color, and a blue color that can not be fully corrected by another second gamma coarse correction to be made by the data electrode driving circuit 4 which makes a gamma correction commonly to the red color, green color, and blue color (to be described later). Here, the first gamma correction represents a gamma correction to be made to arbitrarily provide a luminance characteristic of a reproduced image to luminance of an input image, for example, to have an input image signal be matched to a gamma characteristic of a CRT display (its gamma being about 2.2). Moreover, the second gamma correction represents a gamma correction to be made to have an input image signal be matched to a transmittance characteristic of each of applied voltages for a red color, a green color, and a blue color in a color liquid crystal display 1.

The gray-scale power circuit 3, as shown in FIG. 14, includes resistors $\mathbf{8}_1$ to $\mathbf{8}_{19}$ being cascaded between a terminal for a reference voltage $V_{aa}$ and a ground and voltage followers $\mathbf{9}_1$ to $\mathbf{9}_{17}$ an input terminal of each of which is connected to a connection point among the resistors $\mathbf{8}_1$ to $\mathbf{8}_{19}$ adjacent to one another. The gray-scale power circuit 3 amplifies and buffers each of gray-scale voltages $V_0$ to $V_{17}$ occurring at each of the connection points of the resistors $\mathbf{8}_1$ to $\mathbf{8}_{19}$ adjacent to one another and being set to make the second gamma coarse correction and feeds them to the data electrode driving circuit 4. The data electrode driving circuit 4, as shown in FIG. 14, chiefly includes a multiplexer (MPX) 10, a 8-bit DAC (Digital-to-Analog Converter), and voltage followers $\mathbf{12}_1$ to $\mathbf{12}_{381}$. The MPX 10 switches a set of the gray-scale voltages $V_0$ to $V_8$ or a set of the gray-scale voltages $V_9$ to $V_{17}$ out of the gray-scale voltages $V_0$ to $V_{17}$ fed from the gray-scale power circuit 3 based on a polarity reversing pulse POL fed from the control circuit 2 and feeds the switched voltages to the DAC 11. The DAC 11 makes the second coarse correction described above to corrected red data $D_{RC}$, corrected green data $D_{GG}$, and corrected blue $D_{BG}$ each being of 8 bits based on the set of gray-scale voltages $V_0$ to $V_8$ or the set of gray-scale voltages $V_9$ to $V_{17}$ fed from the MPX 10. Then, the DAC 11 converts the corrected red data $D_{BC}$, corrected green data $D_{GG}$, and corrected blue $D_{BG}$ all having undergone the second gamma coarse correction to an analog data red signal, analog data green signal, and analog data blue signal and then feeds them to each of corresponding voltage followers $\mathbf{12}_1$ to $\mathbf{12}_{384}$. Each of the voltage followers $\mathbf{12}_1$ to $\mathbf{12}_{384}$ amplifies and buffers the data red signal, data green signal, and data blue signal fed from the DAC 11 and feeds the amplified and buffered signal to each of corresponding data electrodes in the color liquid crystal display 11. The scanning electrode driving circuit 5, with timing when a vertical scanning pulse $P_V$ is fed from the control circuit 2, sequentially generates a scanning signal and sequentially applies the generated signal to each of corresponding scanning electrodes in the color liquid crystal display 1.

As described above, in the conventional liquid crystal display device, the control circuit 2 makes the first gamma correction and the second gamma coarse correction individually and separately to each of the red data $D_R$, green data $D_G$, and blue data $D_B$ each being of 8 bits fed from an external. Now let it be assumed that a curve "a" in FIG. 15 shows a gamma characteristic (gray scale—normalized luminance characteristic) of the red data $D_R$, green data $D_G$, and blue data $D_B$ each being of 8 bits fed from an external and that the first gamma correction is to be made to have the input data be matched to a gamma characteristic (gray scale—normalized luminance characteristic, gamma being about 2.2) of a CRT display shown by a curve "b" in FIG. 15. In FIG. 15, the normalized luminance denotes relative luminance obtained when luminance occurring when a maximum gray level (8 bits, that is, 255 gray levels) is displayed is 1 (one).

Therefore, the gamma characteristic of the corrected red data $D_{RG}$, corrected green data $D_{GG}$, and corrected blue data $D_{BG}$ to be output from the control circuit 2, as shown by a curve "c" in FIG. 15, is almost matched to the gamma characteristic (gamma being about 2.2) of the CRT display shown by the curve "b" in FIG. 15. However, as shown in FIG. 16, when portions on the curves "b" and "c" existing, for example, between 150 gray levels and 160 gray levels are magnified, there is no complete matching between values on the curves "b" and "c". Moreover, in FIG. 16, though a relation of the gray shade to the normalized luminance is cyclically reversed, this has occurred due to an error in the measurement and values in the reversed portions are theoretically same. This is because, since red data $D_R$, green data $D_G$, and blue data $D_B$ each being of 8 bits are converted to corrected red data $D_{RG}$, corrected green data $D_{GG}$, and corrected blue data $D_{BG}$ each being 8 bits by arithmetic operations, no gray levels to be originally converted exist and there is no way but to be converted to a nearest gray level. This causes impairment of linearity of a gamma characteristic obtained after the gamma correction has been made.

As a result, for example, as shown in FIG. 17, when an image in which its display luminance increases linearly (the image being called a "gray scale image") from a left to right direction in FIG. 17 is displayed in the color liquid crystal display 1, though a gray level originally should rise gradually from the left to right direction in FIG. 17, however, the gray level on a right side becomes equal to the gray level on a left side, thus causing vertical stripes to be displayed. Therefore, the conventional liquid crystal display cannot be used as a display device for a medical electronic apparatus requiring a display of an image with high definition in particular. To solve this problem, a method in which a number of bits for the red data $D_R$, green data $D_G$, and blue data $D_B$ is increased seems to be available, however, this method causes a circuit size of a whole liquid crystal display device to be made large and expensive.

Moreover, in the conventional liquid crystal display device described above, red data $D_R$, green data $D_G$, blue data $D_B$ each being of 8 bits are converted merely to corrected red data $D_{RG}$, corrected green data $D_{GG}$, and corrected blue data $D_{BG}$ each being of 8 bits. Thus, the conventional liquid crystal display device has shortcomings in that it cannot solve problems related to an environmental chance in ambient temperature, ambient illumination, frequency characteristic of timing signal fed from an external, change in a gamma characteristic of the color liquid crystal display 1 corresponding to luminance of a backlight used to provide light from a rear of the color liquid crystal display 1, and dispersion in a gamma characteristic occurring during a manufacturing process of the color liquid crystal display 1. These disadvantages described above also occur in a driving circuit of a monochrome liquid crystal display in a same manner.

SUMMARY OF THE INVENTION

In view of the above, it is an object of the present invention to provide a method for driving a liquid crystal display which is capable of preventing degradation of linearity of a gamma characteristic occurring after a gamma correction has been made and capable of achieving display of a high quality image in a simple and low-priced configuration and capable of solving problems associated with an environmental change, frequency characteristic of a timing signal, change in a gamma characteristic of a liquid crystal display corresponding to luminance of a backlight, or dispersion in a gamma characteristic occurring during a process of manufacturing a color liquid crystal display, a liquid crystal display device and a monitor provided with the liquid crystal display device.

According to a first aspect of the present invention, there is provided a method for driving a liquid crystal display including:

a first step of obtaining gamma correcting data to which information used to change a gray scale a plurality of times for every digital video data has been added when a gamma correction is made to the digital video data; and a second step of expressing a number of gray scales being larger than a number of gray scales expressed by the digital video data by performing frame rate control in such a manner that a data signal used to change, based on the gamma correcting data, a gray scale a plurality of times for every the digital video data is produced and the produced data signal is sequentially fed to a data electrode in a liquid crystal display.

In the foregoing, a preferable mode is one wherein the first step has a sub-step of obtaining the gamma correcting data from a gray scale calculated by an approximation using two gray levels being nearest to a gray level that provides desired luminance in a gamma characteristic of the liquid crystal display.

Also, a preferable mode is one wherein, in the first step, the gamma correcting data that has been obtained, in advance, by the sub-step described above and that has been stored in a storage medium is read for every the digital video data.

Also, a preferable mode is one wherein, in the first step, the gamma correcting data is obtained by using a first sub-step of measuring luminance to be obtained when a data signal providing a minimum gray level to a maximum gray level is fed to the data electrode in the liquid crystal display to calculate a gamma characteristic of the liquid crystal display and, in order to have the gamma characteristic be matched to a desired gamma characteristic, by using a second sub-step of, if a gray scale obtained by making a gamma correction to a gray level $n_0$ is an integer, employing the obtained gray scale as a new gray level $n_1$ and, if a gray scale obtained by making a gamma correction to the gray level $n_0$ is not an integer, employing a gray scale obtained by substituting two gray levels $n_a$ and $n_b$ being nearest to a gray level that provides desired luminance in a gamma characteristic of the liquid crystal display into an equation (1), as the new gray level $n_1$ and, if the gray level $n_0$ is a minimum gray level or a maximum gray level, employing the gray level $n_0$ as the new gray level $n_1$ without making the gamma correction:

$$n_1=(m_0+m_b\cdot n_a-m_a\cdot n_b)/(m_b-m_a) \quad \text{Equation (1)}$$

where "$m_a$" denotes luminance that can be obtained when a gray level is "$n_a$" in a gamma characteristic of the color liquid crystal display and "$m_b$" denotes luminance that can be obtained when the gray level is "$n_b$" in the gamma characteristic of the color liquid crystal display.

Also, a preferable mode is one wherein, in the first step, the gamma correcting data that has been obtained, in advance, by the first and second sub-steps described above and has been stored in a storage medium is read for every the digital video data.

Also, a preferable mode is one wherein, in the first step, gamma correcting data is obtained to which information used to change a gray scale a plurality of times for every the digital video data has been added when a gamma correction is made to the digital video data and to which a gray-scale correction has been made to make different a voltage of the data signal depending on whether the data signal is fed during a positive frame or during a negative frame while halftones are provided.

Also, a preferable mode is one wherein the first step has a sub-step of obtaining the gamma correcting data from a gray scale calculated by an approximation using two gray levels being nearest to a gray level that provides desired luminance in a gamma characteristic of the liquid crystal display.

Also, a preferable mode is one wherein, in the first step, the gamma correcting data that has been obtained, in advance, by the sub-step described above and that has been stored in a storage medium is read for every the digital video data.

Also, a preferable mode is one wherein, in the first step, the gamma correcting data is obtained by using a first sub-step of measuring luminance to be obtained when a data signal providing a minimum gray level to a maximum gray level is fed to the data electrode in the liquid crystal display to calculate a gamma characteristic of the liquid crystal display, by using a second sub-step of measuring a common potential $V_X$ to be used when each halftone $n_X$ is displayed on the liquid crystal display and of calculating a difference, as a current voltage $V_{DCX}$, between a common potential $V_{REF}$ to be used when a gray scale serving as a reference is displayed on the liquid crystal display and the measured common potential $V_X$, by using a third sub-step of measuring a data signal $V_{nx}$ to be fed to the data electrode when the halftone $n_X$ is displayed on the liquid crystal display, by using a fourth sub-step of, in order to have the gamma characteristic be matched to a desired gamma characteristic, if a gray scale obtained by making a gamma correction to a gray level $n_0$ is an integer, using the obtained gray scale as a new gray level $n_1$ and, if a gray scale obtained by making a gamma correction to the gray level $n_0$ is not an integer, employing a gray scale obtained by substituting two gray levels $n_a$ and $n_b$ nearest to a gray scale that provides desired luminance in a gamma characteristic of the liquid crystal display into an equation (2), as the new gray scale $n_1$ and, in case of a minimum gray level and a maximum gray level, employing the gray level $n_0$ as the new gray scale $n_1$ and, by using a fifth sub-step of, when equations (3) and (4) are derived between a data signal $|V_{n1+}|$ to be fed during a positive frame and data signal $|V_{n1-}|$ to be fed during a negative frame that are applied to the data electrode when the gray level $n_1$ is displayed on the liquid crystal display without making a gray-scale correction and a data signal $|U_{n1+}|$ to be fed during a positive frame and data signal $|U_{n1-}|$ to be fed during a negative frame that are applied to the data electrode when the gray level $n_X$ is displayed on the liquid crystal display by making a gray-scale correction and in case of using a gray scale to be displayed on the liquid crystal display when a data signal $|U_{n1+}|$ to be fed during a positive frame is applied to the data electrode, as a gray level $n_{r+}$, and using a gray scale to be displayed on the liquid crystal display when a data signal $|U_{n1-}|$ to be fed during a negative frame is applied to the data electrode, as a gray level $n_{r-}$, if the gray level $n_{r+}$ and gray level $n_{r-}$ are integers and are a minimum level or a maximum level, employing the gray level $n_{1+}$ and gray level $n_{r-}$ as a gray scale and, if the gray level $n_{r+}$ and gray level $n_{r-}$ are not integers, employing gray levels obtained by substituting two gray levels $n_{c+}$ and $n_{d+}$ to be fed during a positive frame and two gray levels $n_{c-}$ and $n_{d-}$ to be fed during a negative frame being nearest to gray levels that provide the data signal $|U_{n1+}|$ and $|U_{n1-}|$ in a characteristic of the data signal for a gray scale of the liquid crystal display into equations (5) and (6), as gray level $n_{r+}$ and gray level $n_{r-}$:

$$n_1=(m_0+m_b\cdot n_a-m_a\cdot n_b)/(m_b-m_a) \quad \text{Equation (2)}$$

where "$m_a$" denotes luminance that can be obtained when a gray level is "$n_a$" in a gamma characteristic of the color liquid crystal display and "$m_b$" denotes luminance that can be obtained when the gray level is "$n_b$" in the gamma characteristic of the color liquid crystal display:

$$|U_{n1+}|=||V_{n1+}|-V_{DCx}| \quad \text{Equation (3)}$$

$$|U_{n1-}|=||V_{n1-}|+V_{DCx}| \quad \text{Equation (4)}$$

$$n_{r+}=(|U_{n1-}|+|U_{nd+}|\cdot n_c-|U_{nc+}|\cdot n_d)/(|U_{nd+}|-|U_{nc+}|) \quad \text{Equation (5)}$$

where each of the "$|U_{nc+}|$" and "$|U_{nd+}|$" is a data signal used when each of the gray levels $n_c$ and $n_d$ for a positive frame is displayed in the characteristic of the data signal for a gray scale of the liquid crystal display:

$$n_{r-}=(|U_{n1-}|+|U_{nd-}|\cdot n_c-|U_{nc-}|\cdot n_d)/(|U_{nd-}|-|U_{nc-}|) \quad \text{Equation (6)}$$

where each of the "$|U_{nc-}|$" and "$|U_{nd-}|$" is a data signal used when each of the gray levels $n_c$ and $n_d$ to be provided during a negative frame is displayed in the characteristic of the data signal for a gray scale of the liquid crystal display.

Also, a preferable mode is one wherein, in the first step, the correcting data that has been obtained, in advance, by the sub-steps described above and that has been stored in a storage medium is read for every digital video data.

Also, a preferable mode is one wherein the gamma correction is able to be selected from various gamma corrections including a gamma correction to be used for obtaining correspondence to a change in a gamma characteristic of the liquid crystal display caused by a variation in ambient temperature, a gamma correction to be used for obtaining correspondence to a change in a gamma characteristic of the liquid crystal display caused by a variation in ambient illumination, a gamma correction to be used for obtaining correspondence to a gamma characteristic of the liquid crystal display that changes depending on a frequency characteristic of a timing signal, a gamma correction to be used for obtaining correspondence to a gamma characteristic of the liquid crystal display that changes depending on a variation in luminance of a backlight used to provide light to the liquid crystal display from its rear surface, and a gamma correction to be used for obtaining correspondence to dispersion in a gamma characteristic occurring during a process of manufacturing the liquid crystal display.

Also, a preferable mode is one wherein the digital vide data includes red data, green data, and blue data, and the gamma correction is made independently to each of the red data, green data, and blue data.

Also, a preferable mode is one wherein the gamma correction includes a first gamma correction to be made to the red data, green data, and blue data to arbitrarily provide a characteristic of luminance of a reproduced image corresponding to luminance of an input image and a second gamma correction to be made to have an input image signal be matched to a transmittance characteristic of each of applied voltages for a red color, a green color, and a blue color in the liquid crystal display.

Also, a preferable mode is one wherein the information is data used to select a pattern to change the gray scale a plurality of times for every gamma correcting data.

According to a second aspect of the present invention, there is provided a liquid crystal display device including:

a liquid crystal display;

a gamma correcting circuit to obtain gamma correcting data to which information used to change a gray scale a plurality of times for every digital vide data has been added when a gamma correction is made to the digital video data; and a data signal producing circuit to express a number of gray scales being larger than a number of gray scales expressed by the digital video data by performing frame rate control in such a manner that a data signal used to change, based on the gamma correcting data, a gray scale a plurality of times for every the digital video data is produced and the produced data signal is sequentially fed to a data electrode in a liquid crystal display.

In the foregoing, a preferable mode is one wherein the gamma correcting circuit obtains the gamma correcting data from a gray scale calculated by an approximation using two gray levels being nearest to a gray level that provides desired luminance in a gamma characteristic of the liquid crystal display.

Also, a preferable mode is one that wherein includes a corrected data storing circuit in which the gamma correcting data is stored which is obtained from a gray scale calculated by an approximation using two gray levels being nearest to a gray level that provides desired luminance in a gamma characteristic of the liquid crystal display and wherein the gamma correcting circuit reads the gamma correcting data from the corrected data storing circuit for every digital video data and feeds the read data to the data signal producing circuit.

Also, a preferable mode is one wherein the gamma correcting circuit obtains the gamma correcting data by measuring luminance to be obtained when a data signal providing a minimum gray level to a maximum gray level is fed to the data electrode in the liquid crystal display to calculate a gamma characteristic of the liquid crystal display, in order to have the gamma characteristic be matched to a desired gamma characteristic and by employing, if a gray scale obtained by making a gamma correction to a gray level $n_0$ is an integer, the obtained gray scale as a new gray level $n_1$ and, if a gray scale obtained by making a gamma correction to the gray level $n_0$ is not an integer, by employing a gray scale obtained by substituting two gray levels $n_a$ and $n_b$ being nearest to a gray level that provides desired luminance in a gamma characteristic of the liquid crystal display into an equation (7), as the new gray level $n_1$ and, if the gray level $n_0$ is a minimum gray level or a maximum gray level, employing the gray level $n_0$ as the new gray level $n_1$ without making a gamma correction:

$$n_1=(m_0+m_b\cdot n_a-m_a\cdot n_b)/(m_b-m_a) \quad \text{Equation (7)}$$

where "$m_a$" denotes luminance that can be obtained when a gray level is "$n_a$" in a gamma characteristic of a color liquid crystal display and "$m_b$" denotes luminance that can be obtained when the gray level is "$n_b$" in the gamma characteristic of the color liquid crystal display.

A preferable mode is one that wherein includes a corrected data storing circuit storing, in advance, the gamma correcting data obtained by measuring luminance to be obtained when a data signal providing a minimum gray level to a maximum gray level is fed to the data electrode in the liquid crystal display to calculate a gamma characteristic of the liquid crystal display, in order to have the gamma characteristic be matched to a desired gamma characteristic and by employing, if a gray scale obtained by making a gamma correction to a gray level $n_0$ is an integer, the obtained gray scale as a new gray level $n_1$ and, if a gray scale obtained by making a gamma correction to the gray level $n_0$ is not an integer, by employing a gray scale obtained by substituting two gray levels $n_a$ and $n_b$ being nearest to a gray level that provides desired luminance in a gamma characteristic of the liquid crystal display into an equation (8), as the new gray level $n_1$ and, if the gray level $n_0$ is a minimum gray level or a maximum gray level, by employing the gray level $n_0$ as the new gray level $n_1$ without making a gamma correction and wherein the gamma correcting circuit reads the gamma correcting data from the corrected data storing circuit for every digital video data and feeds the read data to the data signal producing circuit:

$$n_1=(m_0+m_b\cdot n_a-m_a\cdot n_b)/(m_b-m_a) \quad \text{Equation (8)}$$

where "$m_a$" denotes luminance that can be obtained when a gray level is "$n_a$" in a gamma characteristic of a color liquid crystal display and "$m_b$" denotes luminance that can be obtained when the gray level is "$n_b$" in the gamma characteristic of the color liquid crystal display.

Also, a preferable mode is one wherein the gamma correcting circuit obtains gamma correcting data to which information used to change a gray scale a plurality of times for every digital video data has been added when a gamma correction is made to the digital video data and to which a gray-scale correction has been made to make different a voltage of the data signal depending on whether the data signal is fed during a positive frame or during a negative frame while halftones are provided.

Also, a preferable mode is one wherein the gamma correcting circuit obtains the gamma correcting data from a gray scale calculated by an approximation using two gray levels being nearest to a gray level that provides desired luminance in a gamma characteristic of the liquid crystal display.

Also, a preferable mode is one that wherein includes a corrected data storing circuit in which the gamma correcting data is stored which is obtained from a gray scale calculated by an approximation using two gray levels being nearest to a gray level that provides desired luminance in a gamma characteristic of the liquid crystal display and wherein the gamma correcting circuit reads the gamma correcting data from the corrected data storing circuit for every digital video data and feeds the read data to the data signal producing circuit.

Also, a preferable mode is one wherein the gamma correcting circuit obtains the gamma correcting data by measuring luminance to be obtained when a data signal providing a minimum gray level to a maximum gray level is fed to the data electrode in the liquid crystal display to calculate a gamma characteristic of the liquid crystal display, by measuring a common potential $V_X$ to be used when each halftone $n_X$ is displayed on the liquid crystal display and by calculating a difference, as a current voltage $V_{DCx}$, between a common potential $V_{REF}$ to be used when a gray scale serving as a reference is displayed on the liquid crystal display and the measured common potential $V_X$, by measuring a data signal $V_{nx}$ to be fed to the data electrode when the halftone $n_X$ is displayed on the liquid crystal display and, in order to have the gamma characteristic be matched to a desired gamma characteristic, if a gray scale obtained by making a gamma correction to a gray level $n_0$ is an integer, by employing the obtained gray scale as a new gray level $n_1$ and, if a gray scale obtained by making a gamma correction to the gray level $n_0$ is not an integer, by employing a gray scale obtained by substituting two gray levels $n_a$ and $n_b$ nearest to a gray scale that provides desired luminance in a gamma characteristic of the liquid crystal display into an equation (9), as the new gray scale $n_1$ and, in case of a minimum gray level and a maximum gray level, by employing the gray level $n_0$ as the new gray scale $n_1$ and, when equations (10) and (11) are derived between a data signal $|V_{n1+}|$ to be fed during a positive frame and data signal $|V_{n1-}|$ to be fed during a negative frame that are applied to the data electrode when the gray level $n_1$ is displayed on the liquid crystal display without making a gray-scale correction and a data signal $|U_{n1+}|$ to be fed during a positive frame and data signal $|U_{n1-}|$ to be fed during a negative frame that are applied to the data electrode when the gray level $n_X$ is displayed on the liquid crystal display by making a gray scale correction and in case of using a gray scale to be displayed on the liquid crystal display when a data signal $|U_{n1+}|$ to be fed during a positive frame is applied to the data electrode, as a gray level $n_{r+}$, and using a gray scale to be displayed on the liquid crystal display when a data signal $|U_{n1-}|$ to be fed during a negative frame is applied to the data electrode, as a gray level $n_{r-}$, if the gray level $n_{r+}$ and gray level $n_{r-}$ are integers and are a minimum level or a maximum level, by employing the gray level $n_{r+}$ and gray level $n_{r-}$ as a gray scale and, if the gray level $n_{r+}$ and gray level $n_{r-}$ are not integers, by employing gray levels obtained by substituting two gray levels $n_{c+}$ and $n_{d+}$ to be fed during a positive frame and two gray levels $n_{c-}$ and $n_{d-}$ to be fed during a negative frame being nearest to gray levels that provide the data signal $|U_{n1+}|$ and $|U_{n1-}|$ in a characteristic of the data signal for a gray scale of the liquid crystal display into equations (12) and (13), as gray level $n_{r+}$ and gray level $n_{r-}$:

$$n_1=(m_0+m_b\cdot n_a-m_a\cdot n_b)/(m_b-m_a) \quad \text{Equation (9)}$$

where "$m_a$" denotes luminance that can be obtained when a gray level is "$n_a$" in a gamma characteristic of a color liquid crystal display and "$m_b$" denotes luminance that can be obtained when the gray level is "$n_b$" in the gamma characteristic of the color liquid crystal display:

$$|U_{n1+}|=||V_{n1+}|-V_{DCx}| \quad \text{Equation (10)}$$

$$|U_{n1-}|=||V_{n1-}|+V_{DCx}| \quad \text{Equation (11)}$$

$$n_{r+}=(|U_{n1+}|+|U_{nd+}|\cdot n_c-|U_{nc+}|\cdot n_d)/(|U_{nd+}|-|U_{nc+}|) \quad \text{Equation (12)}$$

where each of the "$|U_{nc+}|$" and "$|U_{nd+}|$" is a data signal used when each of the gray levels $n_c$ and $n_d$ for a positive frame is displayed in the characteristic of the data signal for a gray scale of the liquid crystal display:

$$n_{r-}=(|U_{n1-}|+|U_{nd-}|\cdot n_c-|U_{nc-}|\cdot n_d)/(|U_d)/(|U_{nd-}|-|U_{nc-}|) \quad \text{Equation (13)}$$

where each of the "$|U_{nc-}|$" and "$|U_{nd-}|$" is a data signal used when each of the gray levels $n_c$ and $n_d$ to be provided during a negative frame is displayed in the characteristic of the data signal for the gray scale of the liquid crystal display.

Also, a preferable mode is one wherein the gamma correcting circuit obtains the gamma correcting data by measuring luminance to be obtained when a data signal providing a minimum gray level to a maximum gray level is fed to the data electrode in the liquid crystal display to calculate a gamma characteristic of the liquid crystal display, by measuring a common potential $V_X$ to be used when each halftone $n_X$ is displayed on the liquid crystal display and by calculating a difference, as a current voltage $V_{DCx}$, between a common potential $V_{REF}$ to be used when a gray scale serving as a reference is displayed on the liquid crystal display and the measured common potential $V_X$, by measuring a data signal $V_{nx}$ to be fed to the data electrode when the halftone $n_X$ is displayed on the liquid crystal display, in order to have the gamma characteristic be matched to a desired gamma characteristic, if a gray scale obtained by making a gamma correction to a gray level $n_0$ is an integer, by employing the obtained gray scale as a new gray level $n_1$ and, if a gray scale obtained by making a gamma correction to the gray level $n_0$ is not an integer, by employing a gray scale obtained by substituting two gray levels $n_a$ and $n_b$ nearest to a gray scale that provides desired luminance in a gamma characteristic of the liquid crystal display into an equation (14), as the new gray scale $n_1$ and, in case of a minimum gray level and a maximum gray level, by employing the gray level $n_0$ as the new gray scale $n_1$ and, when equations (15) and (16) are derived between a data signal $|V_{n1+}|$ to be fed during a positive frame and data signal $|V_{n1-}|$ to be fed during a negative frame that are applied to the data electrode when the gray level $n_1$ is displayed on the liquid crystal display without making a gray-scale correction and a data signal $|U_{n1+}|$ to be fed during a positive frame and data signal $|U_{n1-}|$ to be fed during a negative frame that are applied to the data electrode when the gray level $n_X$ is displayed on the liquid crystal display by making a gray scale correction and in case of using a gray scale to be displayed on the liquid crystal display when a data signal $|U_{n1+}|$ to be fed during a positive frame is applied to the data electrode, as a gray level $n_{r+}$, and using a gray scale to be displayed on the liquid crystal display when a data signal $|U_{n1-}|$ to be fed during a negative frame is applied to the data electrode, as a gray level $n_{r-}$, if the gray level $n_{r+}$ and gray level $n_{r-}$ are integers and are a minimum level or a maximum level, by employing the gray level $n_{r+}$ and gray level $n_{r-}$ as a gray scale and, if the gray level $n_{r+}$ and gray level $n_{r-}$ are not integers, by employing gray levels obtained by substituting two gray levels $n_{c+}$ and $n_{d+}$ to be fed during a positive frame and two gray levels $n_{c-}$ and $n_{d-}$ to be fed during a negative frame being nearest to gray levels that provide the data signal $|U_{n1+}|$ and $|U_{n1-}|$ in a characteristic of the data signal for a gray scale of the liquid crystal display into equations (17) and (18), as gray level $n_{r+}$ and gray level $n_{r-}$ and wherein the gamma correcting circuit reads the gamma correcting data from the corrected data storing circuit for every digital video data and feeds the read data to the data signal producing circuit:

$$n_1=(m_0+m_b\cdot n_a-m_a\cdot n_b)/(m_b-m_a) \quad \text{Equation (14)}$$

where "$m_a$" denotes luminance that can be obtained when a gray level is "$n_a$" in a gamma characteristic of a color liquid crystal display and "$m_b$" denotes luminance that can be obtained when the gray level is "$n_b$" in the gamma characteristic of the color liquid crystal display:

$$|U_{n1+}|=||V_{n1-}|-V_{DCx}| \quad \text{Equation (15)}$$

$$|U_{n1+}|=||V_{n1}|+V_{DCx}| \quad \text{Equation (16)}$$

$$n_{r+}=(|U_{n1+}|+|U_{nd+}|\cdot n_c-|U_{nc+}|\cdot n_d)/(|U_{nd+}|-|U_{nc+}|) \quad \text{Equation (17)}$$

where each of the "$|U_{nc+}|$" and "$|U_{nd+}|$" is a data signal used when each of the gray levels $n_c$ and $n_d$ for a positive frame is displayed in the characteristic of the data signal for a gray scale of the liquid crystal display:

$$n_{r-}=(|U_{n1-}|+|U_{nd+}|\cdot n_c-|U_{nc-}|\cdot n_d)/(|U_{nd-}|-|U_{nc-}|) \quad \text{Equation (18)}$$

where each of the "$|U_{nc-}|$" and "$U_{nd-}|$" is a data signal used when each of the gray levels $n_c$ and $n_d$ to be provided during a negative frame is displayed in the characteristic of the data signal for a gray scale of the liquid crystal display.

Also, a preferable mode is one that wherein includes a corrected data storing circuit which stores, in advance, gamma correcting data on a gamma correction to be used for obtaining correspondence to a change in a gamma characteristic of the liquid crystal display caused by a variation in ambient temperature, gamma correcting data on a gamma correction to be used for obtaining correspondence to a change in a gamma characteristic of the liquid crystal display caused by a variation in ambient illumination, gamma correcting data on a gamma correction to be used for obtaining correspondence to a gamma characteristic of the liquid crystal display that changes depending on a frequency characteristic of a timing signal, gamma correcting data on a gamma correction to be used for obtaining correspondence to a gamma characteristic of the liquid crystal display that changes depending on a variation in luminance of a backlight used to provide light to the liquid crystal display from its rear surface, and gamma correcting data on a gamma correction to be used for obtaining correspondence to dispersion in a gamma characteristic occurring during a process of manufacturing the liquid crystal display and feeds gamma correcting data selected by correction pattern selecting data to be fed from an external to the gamma correcting circuit and wherein the gamma correcting circuit reads the gamma correcting data from the corrected data storing circuit for every digital video data and feeds the read data to the data signal producing circuit.

Also, a preferable mode is one wherein the corrected data storing circuit stores, in advance, gamma correcting data on a gamma correction to be used for obtaining correspondence to a change in a gamma characteristic of the liquid crystal display caused by a variation in ambient temperature, gamma correcting data on a gamma correction to be used for obtaining correspondence to a change in a gamma characteristic of the liquid crystal display caused by a variation in ambient illumination, gamma correcting data on a gamma correction to be used for obtaining correspondence to a gamma characteristic of the liquid crystal display that changes depending on a frequency characteristic of a timing signal, gamma correcting data on a gamma correction to be used for obtaining correspondence to a gamma characteristic of the liquid crystal display that changes depending on a variation in luminance of a backlight used to provide light to the liquid crystal display from its rear surface, and gamma correcting data on a gamma correction to be used for obtaining correspondence to dispersion in a gamma characteristic occurring during a process of manufacturing the liquid crystal display and feeds gamma correcting data selected by correction pattern selecting data to be fed from an external to the gamma correcting circuit and wherein the gamma correcting circuit reads the gamma correcting data from the corrected data storing circuit for every digital video data and supplies the read data to the data signal producing circuit.

Also, a preferable mode is one wherein the digital vide data includes red data, green data, and blue data, and the gamma correction is made independently to each of the red data, green data, and blue data.

Also, a preferable mode is one wherein the gamma correction includes a first gamma correction to be made to the red data, green data, and blue data to arbitrarily provide a characteristic of luminance of a reproduced image corresponding to luminance of an input image and a second gamma correction to be made to have an input image signal be matched to a transmittance characteristic of each of applied voltages for a red color, a green color, and a blue color in the liquid crystal display.

Furthermore, a preferable mode is one wherein the information is data used to select a pattern to change the gray scale a plurality of times for every gamma correcting data.

According to a third aspect of the present invention, there is provided a monitor having the liquid crystal display device described above.

With the above configurations, by obtaining gamma correcting data to which information used to change a gray scale a plurality of times for every digital video data has been added when a gamma correction is made to digital video data, and then by performing frame rate control in such a manner that a data signal is produced which changes a gray scale a plurality of times for every digital video data based on gamma correcting data and that the produced data signal is fed to a data electrode in a liquid crystal display, a number of gray scales being larger than a number of gray scales expressed by the digital video data can be expressed. This enables degradation of linearity in a gamma characteristic occurring after the gamma correction has been made to be prevented in a simple and low-cost configuration. As a result, it is possible to achieve display of an image of high quality.

Also, with the above configurations, gamma correcting data is obtained to which information used to change a gray scale a plurality of times for every digital vide data has been added when a gamma correction is made to digital video data and to which a gray-scale correction has been made in which a voltage of a data signal is made different depending on whether the data signal is fed during a positive frame or during a negative frame while halftones are provided. Therefore, configurations of the data electrode driving circuit employed in the present invention can be made simple and a chip area can be reduced accordingly. This enables configurations of the present invention to fully meet recent requirements for savings in space to a liquid crystal display device.

Furthermore, the gamma correction to be employed in the method of the present invention can be selected from various gamma corrections including a gamma correction to be used for obtaining correspondence to a change in a gamma characteristic of a liquid crystal display caused by a variation in ambient temperature, a gamma correction to be used for obtaining correspondence to a change in a gamma characteristic of a liquid crystal display caused by a variation in ambient illumination, a gamma correction to be used for obtaining correspondence to a gamma characteristic of a liquid crystal display that changes depending on a frequency characteristic of a timing signal, a gamma correction to be used for obtaining correspondence to a gamma characteristic of a liquid crystal display that changes depending on a variation in luminance of a backlight used to provide light to the liquid crystal display from its rear surface, and a gamma correction to be used for obtaining correspondence to dispersion in a gamma characteristic occurring during a process of manufacturing a liquid crystal display. This enables a solution to problems associated with environmental changes in ambient temperature, ambient illumination, or a like, a frequency characteristic of a timing signal, a change in a gamma characteristic of a liquid crystal display caused by a variation in luminance of a backlight, and dispersion in a gamma characteristic occurring during a process of manufacturing a liquid crystal display.

BRIEF DESCRIPTION OF THE DRAWINGS

The above and other objects, advantages, and features of the present invention will be more apparent from the following description taken in conjunction with the accompanying drawings in which:

FIG. 2 is a conceptual diagram showing configurations of a gamma correction data storing circuit 22 making up the liquid crystal display device of FIG. 1;

FIG. 5 is a diagram showing one example of a data format of first corrected data being of 10 bits;

FIG. 6 is a diagram showing one example of an algorithm to output second corrected data of 10 bits;

DETAILED DESCRIPTION OF THE PREFERRED EMBODIMENTS

Best modes of carrying out the present invention will be described in further detail using various embodiments with reference to the accompanying drawings.

First Embodiment

Figure 1:
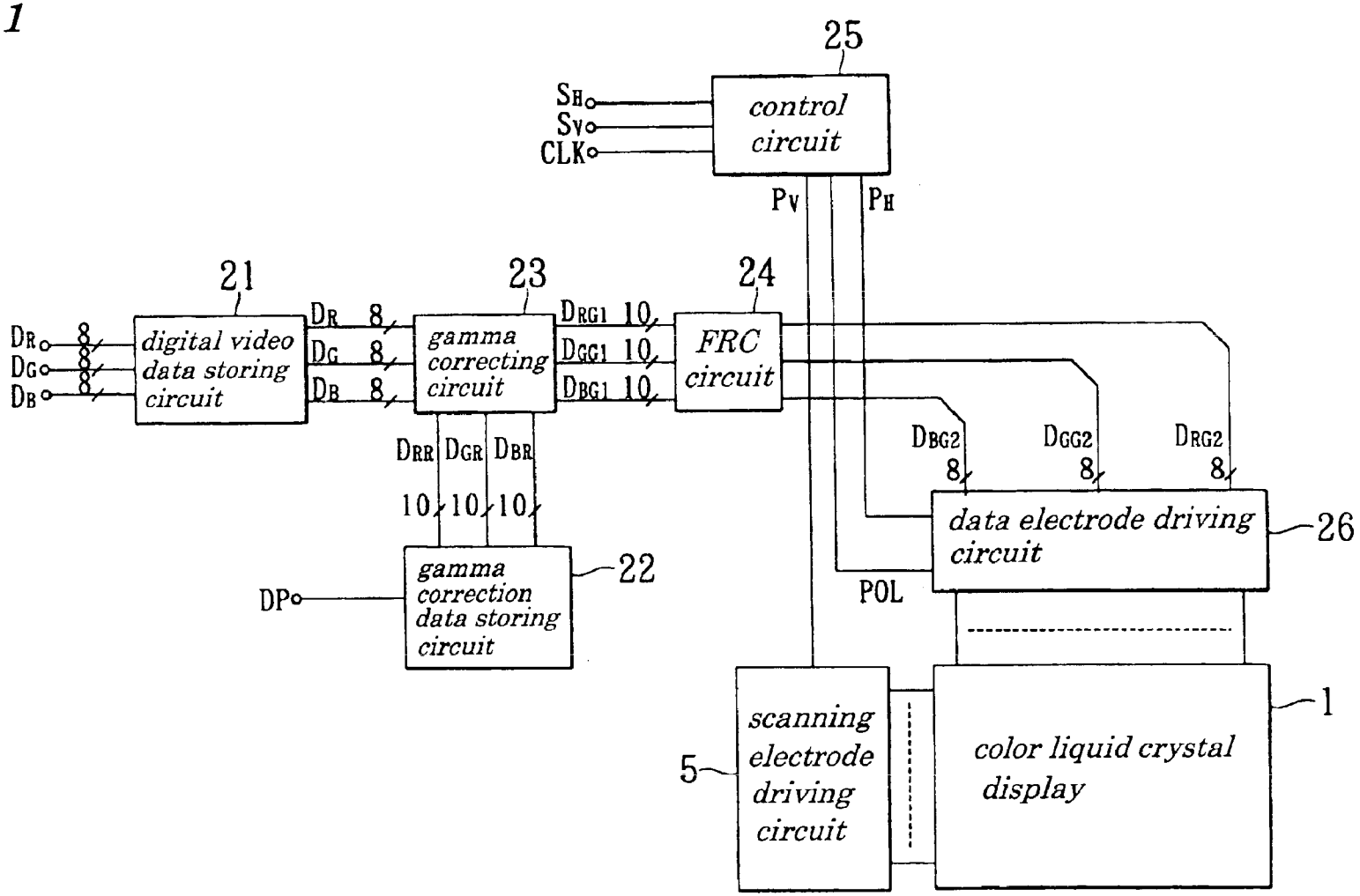
FIG. 1 is a schematic block diagram showing configurations of a liquid crystal display device employing a method for driving a liquid crystal display according to a first embodiment of the present invention.

FIG. 1 is a schematic block diagram showing configurations of a liquid crystal display device employing a method for driving a liquid crystal display according to a first embodiment of the present invention. In FIG. 1, same reference numbers are assigned to corresponding parts having same functions as in FIG. 13 and their descriptions are omitted accordingly. The liquid crystal display device of the first embodiment includes, instead of the control circuit 2, the gray-scale power circuit 3, and the data electrode driving circuit 4 shown in FIG. 13, newly a digital video data storing circuit 21, a gamma correction data storing circuit 22, a gamma correcting circuit 23, a FRC (Frame Rate Control) circuit 24, a control circuit 25, and a data electrode driving circuit 26.

The digital vide data storing circuit 21 is made up of a semiconductor memory such as a RAM (Random Access Memory) or a like and stores digital video data including a red data $D_R$, green data $D_G$, and blue data $D_B$ each being of 8 bits to be fed from an external. The gamma correction data storing circuit 22 is made up of a semiconductor memory such as a ROM (Read Only Memory), RAM, or a non-volatile semiconductor memory such as a flush EEPROM (Electrically Erasable Programmable ROM) or a like. The gamma correction data storing circuit 22 stores in advance red data $D_{RR}$, green corrected data $D_{GR}$, and blue corrected data $D_{BR}$ each being of 10 bits and being corresponded to each of 8 types of correcting patterns (Pattern 1 to Pattern 8) and feeds red corrected data $D_{RR}$, green corrected data $D_{GR}$, and blue corrected data $D_{BR}$ each corresponding to a correcting pattern selected by corrected pattern selecting data DP of 3 bits to be fed from an external. The red corrected data $D_{RR}$, green corrected data $D_{GR}$, and blue corrected data $D_{BR}$ each being of 10 bits are used, as in the conventional case, to prevent degradation in linearity of a gamma characteristic occurring after red data $D_R$ green data $D_G$, and blue data $D_B$ each being of 8 bits have been gamma-corrected to produce corrected red data $D_{RG}$, corrected green data $D_{GG}$, and corrected blue data $D_{BG}$ each being of 8 bits.

The correcting patterns of 8 types include, for example, a correcting pattern used to have an image signal to be matched to a change in a gamma characteristic of a color liquid crystal display 1 corresponding to a variation in an ambient temperature of the liquid crystal display device, a correcting pattern used to have an image signal to be matched to a change in a gamma characteristic of the color liquid crystal display 1 corresponding to a variation in ambient illumination of the liquid crystal display device, a correcting pattern used to have an image signal to be matched to a gamma characteristic of the color liquid crystal display 1 which changes depending on a frequency characteristic of a timing signal, a correcting pattern used to have an image signal to be matched to a gamma characteristic of the color liquid crystal display 1 which changes depending on a variation in luminance of a backlight, a correcting pattern used to have an image signal to be matched to dispersion in a gamma characteristic which occurs during a process of manufacturing the color liquid crystal display 1, or a like.

The red corrected data $D_{RR}$, green corrected data $D_{GR}$, and blue corrected data $D_{BR}$ for every correcting pattern are made up of values used to measure, in advance, a gamma characteristic of the color liquid crystal display 1 obtained when ambient temperature or ambient illumination of the liquid crystal display device being in a mounted state, frequency characteristic of a timing signal, luminance of the backlight are changed or dispersion in a gamma characteristic occurring during a process of manufacturing the color liquid crystal display 1 and to remove influences caused by variation or dispersion by making a gamma correction. That is, the gamma correction of the embodiment includes the first gamma correction and second gamma correction described above.

FIG. 2 is a conceptual diagram showing configurations of the gamma correction data storing circuit 22 making up the liquid crystal display device of FIG. 1. As shown in FIG. 2, red corrected data $D_{RR}$, green corrected data $D_{GR}$, and blue corrected data $D_{BR}$ are stored for every correcting pattern. In low-order 10 bits of A9 to A0 in an address, 0 to 255 (decimal) are assigned as a storing region for the red corrected data $D_{RR}$, 256 to 511 (decimal) are assigned as a storing region for the green corrected data $D_{GR}$, and 512 to 767 (decimal) are assigned as a storing region for the blue corrected data $D_{BR}$. In high-order 3 bits of A12 to A10, 0 (decimal) is assigned as a storing region for Pattern 1, 1 (decimal) is assigned as a storing region for Pattern 2, 2 (decimal) is assigned as a storing region for Pattern 3, 3 (decimal) is assigned as a storing region for Pattern 4, 4 (decimal) is assigned as a storing region for Pattern 5, 5 (decimal) is assigned as a storing region for Pattern 6, 6 (decimal) is assigned as a storing region for Pattern 7, and 7 (decimal) is assigned as a storing region for Pattern 8. Therefore, the corrected pattern selecting data DP described above corresponds to the value of the high-order 3 bits of A12 to A10 in the correcting pattern to be selected.

Next, a method for calculating the above red corrected data $D_{RR}$, green corrected data $D_{GR}$, and blue corrected data $D_{BR}$ is described.

Figure 3:
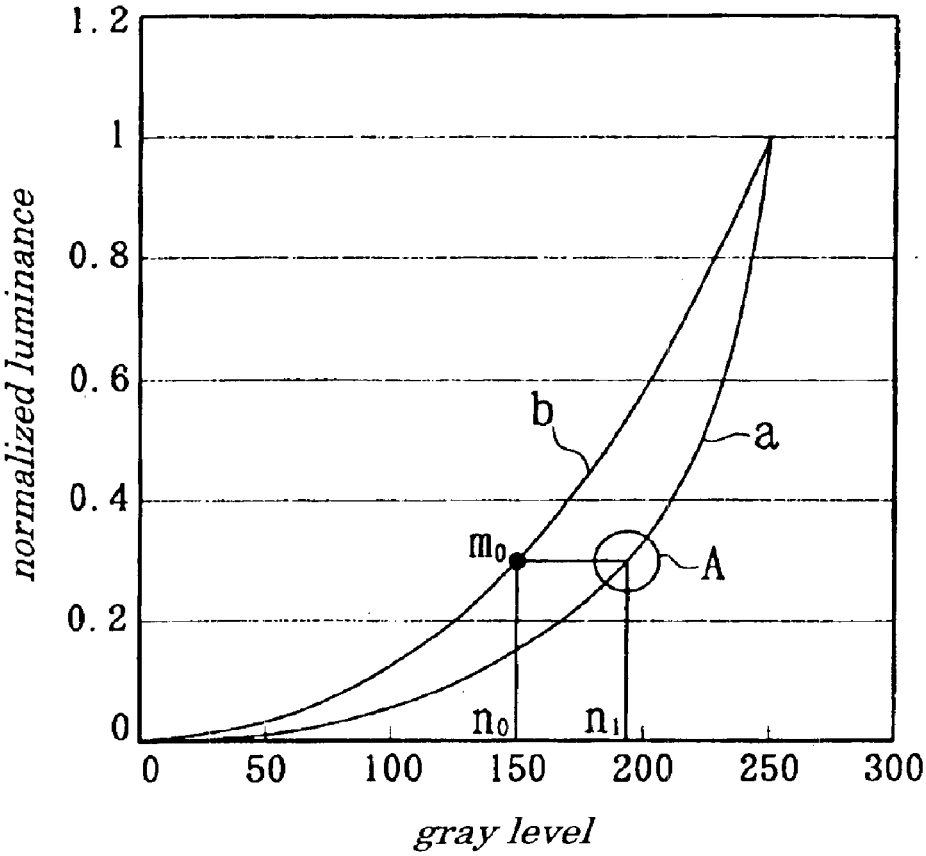
FIG. 3 is a diagram showing one example of a gamma characteristic of a CRT display and of a color liquid crystal display device.

(1) First, luminance that can be obtained when a data signal of 0 to 255 gray levels is applied to a data electrode in the color liquid crystal display 1 is measured to calculate a gamma characteristic of the color liquid crystal display. Here, FIG. 3 shows one example of the calculated gamma characteristic using a curve "a". In FIG. 3, the curve "b" shows one gamma characteristic to be matched by making a gamma correction, for example, a gamma characteristic (gamma being about 2.2) of a CRT display.

(2) Second, a gamma correction is made by a following method in order to have a gamma characteristic of the color liquid crystal display 1 be matched to a desired gamma characteristic, for example, to a gamma characteristic of a CRT display, that is, in order to have normalized luminance in the gamma characteristic of the color liquid crystal display 1 become same as that in the gamma characteristic of the CRT display at a certain gray level. As shown in FIG. 3, in the curve "b" showing the gamma characteristic of the CRT display, when the gray level is "$n_0$", its normalized luminance is "$m_0$", while, in the curve "a" showing the gamma characteristic of the color liquid crystal display 1, a gray level to make its normalized luminance be "$m_0$" is "$n_1$". Therefore, when the gray level "$n_0$" is input, the gray level "$n_1$" is output. The gray level "$n_1$" is obtained by a following method.

(a) It a gray level obtained by making a gamma correction to the gray level "$n_0$" is an integer, the obtained gray level, as it is, is used as the gray level "$n_1$".

Figure 4:
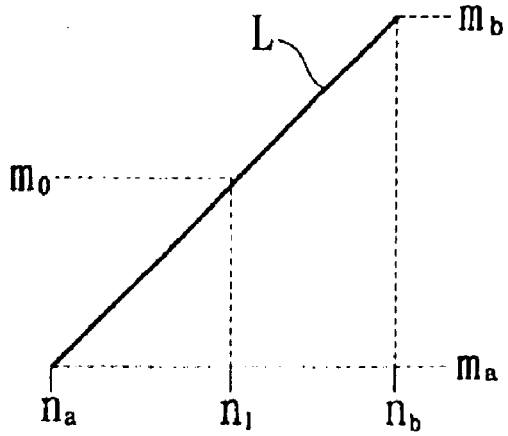
FIG. 4 is an enlarged diagram of a portion "A" in FIG. 3.

(b) If a gray level obtained by making a gamma correction to the gray level "$n_0$" is not an integer, a gray level obtained by substituting two gray levels "$n_a$" and "$n_b$" (see FIG. 4) being nearest to a gray level that can make the normalized luminance be "$m_0$" in the curve "a" showing the gamma characteristic of the color liquid crystal display 1, into an equation (101), is used as the gray scale "$n_1$". FIG. 4 is an enlarged diagram of a portion "A" in FIG. 3. In FIG. 4, the straight line L is an approximate straight line of the curve "a" shown in FIG. 3.

$$n_1=(m_0+m_b\cdot n_a-m_a\cdot n_b)/(m_b-m_a) \qquad \text{Equation (101)}$$

where "$m_a$" denotes normalized luminance that can be obtained when a gray level is "$n_a$" in the curve "a" showing the gamma characteristic of the color liquid crystal display 1 and "$m_b$" denotes normalized luminance that can be obtained when a gray level is "$n_b$" in the curve "a" showing the gamma characteristic of the color liquid crystal display 1.

Now, a method for obtaining the equation (101) will be explained below. Generally, the straight line "L".is expressed by an equation (102).

$$y=\alpha x+\beta \qquad \text{Equation (102)}$$

where "$\alpha$" denotes a gradient and "$\beta$" denotes an intercept. By substituting values of two coordinates ($n_a$, $m_a$) and ($n_b$, $m_b$) shown in FIG. 4 into the equation (102), equations (103) and (104) can be derived:

$$m_a=\alpha n_a+\beta \quad \text{Equation (103)}$$

$$m_b=\alpha n_b+\beta \quad \text{Equation (104)}$$

By subtracting the equation (103) from the equation (104) and by rearranging with respect to the gradient α, an equation (105) can be derived:

$$\alpha=(m_b-m_a)/(n_b-n_a) \quad \text{Equation (105)}$$

Moreover, by adding the equation (103) to the equation (104) and by substituting the equation (105) and rearranging with respect to the intercept β, an equation (106) can be obtained:

$$\beta=(m_a\cdot n_b-m_b\cdot n_a)/(n_b-n_a) \quad \text{Equation (106)}$$

Since the gray levels $n_a$ and $n_b$ are values being adjacent to each other, a relation between them is given by an equation (107):

$$n_b-n_a=1 \quad \text{Equation (107)}$$

Therefore, by substituting the equation (107) into the equation (105) and the equation (106), equations (108) and (109) can be obtained:

$$\alpha=m_b-m_a \quad \text{Equation (108)}$$

$$\beta=m_a\cdot n_n-m_b\cdot n_a \quad \text{Equation (109)}$$

By substituting the equations (108) and (109) into the equation (102), an equation (110) can be obtained:

$$y=(m_b-m_a)x+m_a\cdot n_b-m_c\cdot n_a \quad \text{Equation (110)}$$

By substituting values of coordinates ($n_1$, $m_0$) into the equation (110) and rearranging with respect to the gray level "$n_1$", the equation (101) can be obtained.

(c) No gamma correction is made both to a minimum gray scale, that is, 0 gray levels and to a maximum gray scale, that is, 255 gray levels and they are used, as they are, as a gray scale.

Next, by substituting the obtained 8 bits of the gray level "$n_1$" (decimal) into the equation (111), the gray level "$n'_1$" (decimal) is calculated:

$$n'_1=INT(4\cdot n_1+0.5) \quad \text{Equation (111)}$$

where "INT( )" represents that only an integral portion of a result from arithmetic operations within the parentheses is used.

By using methods of calculation described above, red corrected data $D_{RR}$, green corrected data $D_{GR}$, and blue corrected data $D_{BR}$ for all correcting patterns are calculated.

The gamma correcting circuit 23 provides a gray shade by making a gamma correction to red data $D_R$, green data $D_G$, and blue data $D_B$ each being of 8 bits to be fed from the digital video data storing circuit 21 by using red corrected data $D_{RR}$, green corrected data $D_{GR}$, and blue corrected data $D_{BR}$ each being of 10 bits to be fed from the gamma correction data storing circuit 22. Then, the gamma correcting circuit 23 feeds each of results from the gamma correction as first corrected red data $D_{RG1}$, first corrected green data $D_{GG1}$, and first corrected blue data $D_{BC}$ each being of 10 bits to the FRC circuit 24. The gamma correction to be made by the gamma correcting circuit 23 includes the first gamma correction and the second gamma correction. The gamma correcting circuit 23 males a gamma correction, based on red data $D_R$, green data $D_G$, and blue data $D_B$ each being 8 bits and by selecting red corrected data $D_{RR}$, green corrected data $D_{GR}$, and blue corrected data $D_{BR}$ each being 10 bits of a correcting pattern selected by corrected pattern selecting data DP from the gamma correction data storing circuit 22.

The FRC circuit 24 performs frame rate control on the first corrected red data $D_{RG1}$, first corrected green data $D_{GG1}$, and first corrected blue data $D_{BG1}$ (see FIG. 2) each being 10 bits fed from the gamma correcting circuit 23 to convert them to second corrected red data $D_{RG}$, second corrected green data $D_{RG2}$, and second corrected blue data $D_{BG2}$ each being of 8 bits and feeds the converted data to the data electrode driving circuit 26. The frame rate control is a driving method for expressing a number of gray levels being larger than that of gray levels to be displayed when the color liquid crystal display 1 is driven by a normal driving method. For example, when each of the number of bits of the red data $D_R$, green data $D_G$, and blue data $D_B$ making is "8", if a normal driving method is used, only 255 gray levels can be expressed. In contrast, if each of the number of bits of the red data $D_R$, green data $D_G$, and blue data $D_B$ making digital video data is "10", 1024 gray levels can be expressed. However, when the liquid crystal display device is so configured that the number of bits of red data $D_R$, green data $D_G$, and blue data $D_B$ making up digital video data is originally 10, instead of 8, as described above, a circuit size of the whole liquid crystal display device becomes larger, as a result, causing high price. To solve this problem, according to the embodiment, by using the frame rate control, that is, by utilizing an effect of persistence of a human's vision, a gray scale that compares favorably with a gray scale expressed by the red data $D_R$, green data $D_G$, and blue data $D_B$ in a large number of bits can be expressed by the red data $D_R$, green data $D_G$, and blue data $D_B$ in a small number of bits. In other words, one image having a gray level being "a" ("a" is a natural number) and another image having a gray level being "a+1" are displayed alternately in a repeated manner with timing when a vertical sync signal Sv is fed, the two images are viewed by human eye as an image having intermediate luminance (hereinafter referred to as <a, a+1> luminance) between luminance occurring when the image having the gray level being "a" is displayed and luminance occurring when the image having the gray level being "a+1" is displayed. Moreover, with timing when a vertical sync signal Sv is fed, after one image having a gray level being "a" has been displayed once, if another image having a gray level being "(a+1)" is displayed twice in a repeated manner, the two images are viewed by human eye as an image having intermediate luminance between luminance occurring when the image having the gray level being "(a+1)" and luminance occurring when the image having the gray level being the <a, a+1> luminance.

Therefore, the FRC circuit 24 performs frame rate control on the first corrected red data $D_{RG1}$, first corrected green data $D_{GG1}$, and first corrected blue data $D_{BG1}$ (being collectively called "first corrected data") each being of 10 bits to be fed from the gamma correcting circuit 23, with timing when the vertical sync signal Sv described above is applied, and feeds the data as second corrected red data $D_{RG}$, second green data $D_{GG2}$, and second corrected blue data $D_{BG2}$ each being of 8 bits (being collectively called "second corrected data") to the data electrode driving circuit 26. Specifically, in a data format for first corrected data being of 10 bits, each of the data D1 and D0 corresponding to each of low-order 2 bits B1 and B0 represents expanded data and each of the data D9 to D2 corresponding to each of the high-order 8 bits B9 to B2 represents data to be displayed when the color liquid crystal display 1 is driven by an ordinary driving method.

FIG. 6 shows an algorithm adapted to output second corrected data. That is, if a combination of the data D1 and D0 corresponding to the low-order 2 bits of first corrected data is "00", the data D9 to D2 (providing a gray level "a") corresponding to high-order 8 bits are fed as second corrected data to the data electrode driving circuit 26. If a combination of the data D1 and D0 corresponding to the low-order 2 bits of the first corrected data is "01", during a first frame to a third frame, the data D9 to D2 (having a gray level being "a") corresponding to the high-order 8 bits are fed as second corrected data to the data electrode driving circuit 26 and, during a fourth frame, data (providing a gray level "(a+1)") obtained by adding 1 (one) to the data D9 to D2 corresponding to the high-order 8 bits is fed as second corrected data to the data electrode driving circuit 26. The above operations are repeated during every four frame. For example, after the first corrected data being a still picture has been output during a first frame, corrected data to be input during subsequent three frames are neglected and data out of the first corrected data output during the second to fourth frames fed, as second correcting data, to the data electrode driving circuit 26.

Similarly, if a combination of the data D1 and D0 corresponding to the low-order 2 bits of the first corrected data is "10", during the first frame and second frame, the data D9 to D2 (having a gray level being "a") corresponding to high-order 8 bits are fed, as second corrected data, to the data electrode driving circuit 26 and, during the third and fourth frame, data (having a gray level being "(a+1)") obtained by adding 1 (one) to the data D9 to D2 corresponding to the high-order 8 bits is fed, as second corrected data, to the data electrode driving circuit 26. The above operation is repeated during every four frames. If a combination of the data D1 and D0 corresponding to the low-order 2 bits of the first corrected data is "11", during the first frame, the data D9 to D2 (having a gray level being "a") corresponding to high-order 8 bits are fed as second corrected data to the data electrode driving circuit 26 and, during the second frame to fourth frame, data obtained by adding 1 (one) to the data D9 to D2 (providing a gray level "(a+1)") is fed, as second corrected data, to the data electrode driving circuit 26. These operations are repeated during every four frames.

Moreover, refer to Japanese Patent Application Laid-open Nos. Hei 2-285391, Hei 5-249436, or a like for details of configurations and operations of the FRC circuit.

Thus, by incorporating such the FRC circuit, a liquid crystal display device can be easily configured at less costs, compared with a case where the number of bits of red data $D_R$, green data $D_G$, and blue data $D_B$ to be processed is merely made larger.

The control circuit 25 is made up of, for example, an ASIC. The control circuit 25, based on a horizontal sync signal $S_H$, vertical sync signal $S_V$, clock CLK, or a like, generates a horizontal scanning pulse $P_H$, vertical scanning pulse $P_V$, and polarity reversing pulse POL and feeds the generated pulses to the data electrode driving circuit 26 and the scanning electrode driving circuit 5.

The data electrode driving circuit 26, based on a horizontal scanning pulse$_H$ and polarity reversing pulse POL both being fed from the control circuit 25, converts the second corrected red data $D_{RG}$, second corrected green data $D_{GG2}$, and second corrected blue data $D_{BG2}$ each being of 8 bits and being fed from the FRC circuit 24 to an analog data red signal, analog data green signal, and analog data blue signal and then feeds the converted signals sequentially to a corresponding electrode in the color liquid crystal display 1.

Next, operations of the liquid crystal display device having configurations described above will be explained. First, when a signal "000" (binary) used to select Pattern 1 shown in FIG. 2 is fed from an external as corrected pattern selecting data DP, red corrected data $D_{RR}$, green corrected data $D_{GR}$, and blue corrected data $D_{BR}$ each being of 10 bits corresponding to the Pattern 1 are sequentially read from a storing region having addresses A12 to A0 being "0" to "767" (decimal) in the gamma correction data storing circuit 22 and the read data are fed to the gamma correcting circuit 23. This Pattern 1 is a correcting pattern used to have an input image signal be matched to, for example, a change in a gamma characteristic of the color liquid crystal display 1 caused by a variation in ambient temperature of the liquid crystal display device.

Next, when digital video data made up of red data $D_R$, green data $D_G$, and blue data $D_B$ each being of 8 bits is fed from an external, the digital video data, after having been stored once in the digital video data storing circuit 21, is read and is fed to the gamma correcting circuit 23. The gamma correcting circuit 23 provides a gray scale by making a gamma correction to the red data $D_R$, green data $D_G$, and blue data $D_B$ each being of 8 bits to be fed from the digital video data storing circuit 21 by using red corrected data $D_{RR}$, green corrected data $D_{GR}$, and blue corrected data $D_{BR}$ each being of 10 bits to be fed from the gamma correction data storing circuit 22. Then, the gamma correcting circuit 23 feeds each of results from the gamma correction to the FRC circuit 24 as first corrected red data $D_{RG1}$, first corrected green data $D_{GG1}$, and first corrected blue data $D_{BG1}$ each being of 10 bits.

Next, the FRC circuit 24 performs frame rate control on the first corrected red data $D_{RG1}$, first corrected green data $D_{GG1}$, and first corrected blue data $D_{BG1}$ each being of 10 bits to be fed from the gamma correcting circuit 23 to convert them to second corrected red data $D_{RG2}$, second corrected green data $D_{GG2}$, and second corrected blue data $D_{BG2}$ each being of 8 bits and feeds the converted data to the data electrode driving circuit 26. Also, the control circuit 25, based on a horizontal sync signal $S_H$, vertical sync signal $S_V$, and clock CLK and a like fed from an eternal, generates a horizontal scanning pulse $P_H$, vertical sync pulse $P_V$, and polarity reversing pulse POL and feeds these pulses to the data electrode driving circuit 26 and scanning electrode driving circuit 5. As a result, the data electrode driving circuit 26, based on a horizontal scanning pulse $P_H$ and polarity reversing pulse POL to be fed from the control circuit 25, converts the second corrected red data $D_{RG2}$, second corrected green data $D_{GG2}$, and second corrected blue data $D_{BG2}$ each being of 8 bits and to be fed from the FRC circuit 24 to analog data red signal, analog data green signal, and analog data blue signal and then sequentially feeds each of the converted signals to a corresponding electrode in the color liquid crystal display 1. Moreover, the scanning electrode driving circuit 5, with timing when a vertical scanning pulse $P_V$ is fed from the control circuit 2, sequentially generates scanning signals and applies each of the generated signals to a corresponding scanning electrode in the color liquid crystal display 1.

By operations performed as described above, an image with high quality can be displayed on the color liquid crystal display 1 even when a gamma characteristic of the color liquid crystal display 1 is changed due to variations in ambient temperature of the liquid crystal display device.

Thus, according to the embodiment, first corrected red data $D_{RG1}$, first corrected green data $D_{GG1}$, and first corrected blue data $D_{BG1}$ each being of 10 bits are obtained by making a gamma correction to red data $D_R$, green data $D_G$, and blue data $D_B$ each being of 8 bits to be fed from an external in the gamma correcting circuit 23. Moreover, the FRC circuit 24 performs frame rate control on the first corrected green data $D_{GG1}$, and first corrected blue data $D_{BG1}$ each being of 10 bits to convert them to second corrected red data $D_{RG}$, second corrected green data $D_{GG2}$, and second corrected blue data $D_{BG2}$. This enables prevention of degradation in linearity of a gamma characteristic occurring after the gamma correction has been made in a simple and low-priced configuration and makes it possible to achieve display of an image of high quality.

Moreover, according to the embodiment, red corrected data $D_{RR}$, green corrected data $D_{GR}$, and blue corrected data $D_{BR}$ corresponding to 8 types of correcting patterns are stored, in advance, in the gamma correction data storing circuit 22, and red corrected data $D_{RR}$, green red corrected $D_{GR}$, and blue corrected data $D_{BR}$ corresponding to the correcting pattern selected by corrected pattern selecting data DP are fed to the gamma correcting circuit 23. This enables the liquid crystal display device of the embodiment to respond to environmental changes in ambient temperature, ambient illumination, or a like, frequency characteristic of a timing signal to be fed from an external, changes in gamma characteristics in the color liquid crystal display 1 caused by variations in luminance of a backlight, or dispersion in gamma characteristics occurring in a process of manufacturing the color liquid crystal display 1.

Second Embodiment

Figure 7:
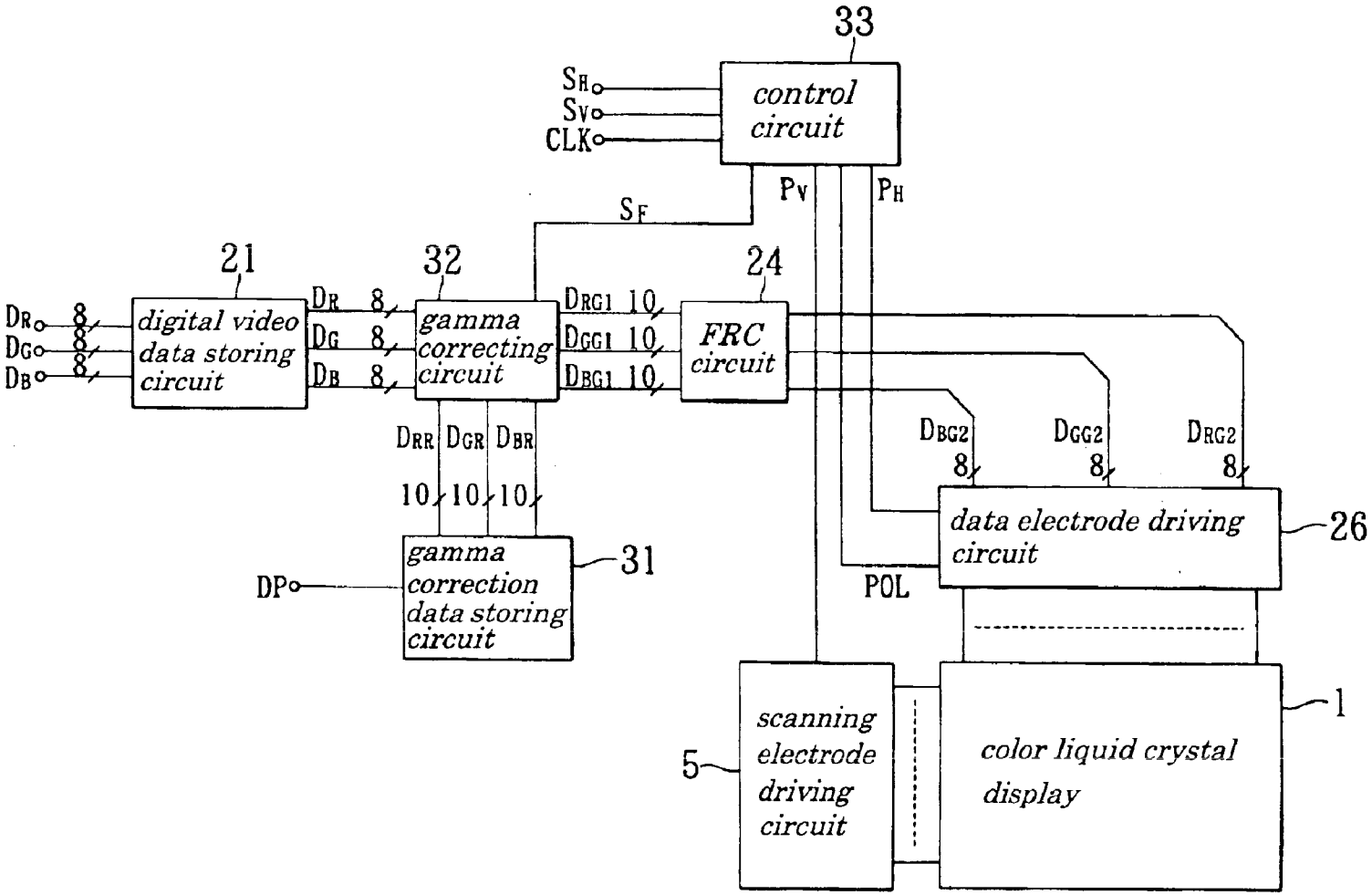
FIG. 7 is a schematic block diagram showing a configuration of a liquid crystal display device employing a method for driving a liquid crystal display of a second embodiment of the present invention.

FIG. 7 is a schematic block diagram showing a configuration of a liquid crystal display device employing a method for driving a liquid crystal display of a second embodiment of the present invention. In FIG. 7, same reference numbers are assigned to corresponding parts having same functions as in FIG. 1 and their descriptions are omitted accordingly. The liquid crystal display device of the second embodiment includes, instead of the gamma correction data storing circuit 22, gamma correcting circuit 23, and control circuit 25 shown in FIG. 1, newly a gamma correcting data storing circuit 31, a gamma correcting circuit 32 and a control circuit 33. The liquid crystal display device of the embodiment has a gray-scale correcting function by which a voltage of data red signal, data green signal, and data blue signal is made different, when a gamma correction is made, depending on whether a signal is fed during a positive frame or during a negative frame when halftones are provided. Moreover, the liquid crystal display of the embodiment, as described later, makes a gamma correction and a gray-scale correction based on contents being stored in the gamma correcting data storing circuit 31, that is, each value of luminance to be obtained when each gray shade is displayed on the color liquid crystal display 1, a value of a feedthrough component (direct current component) of a common potential $V_{com}$ at each gray level in the color liquid crystal display 1, and a value of a data signal to be fed to a data electrode to be obtained when each gray shade is displayed on the color liquid crystal display 1.

Figure 8:
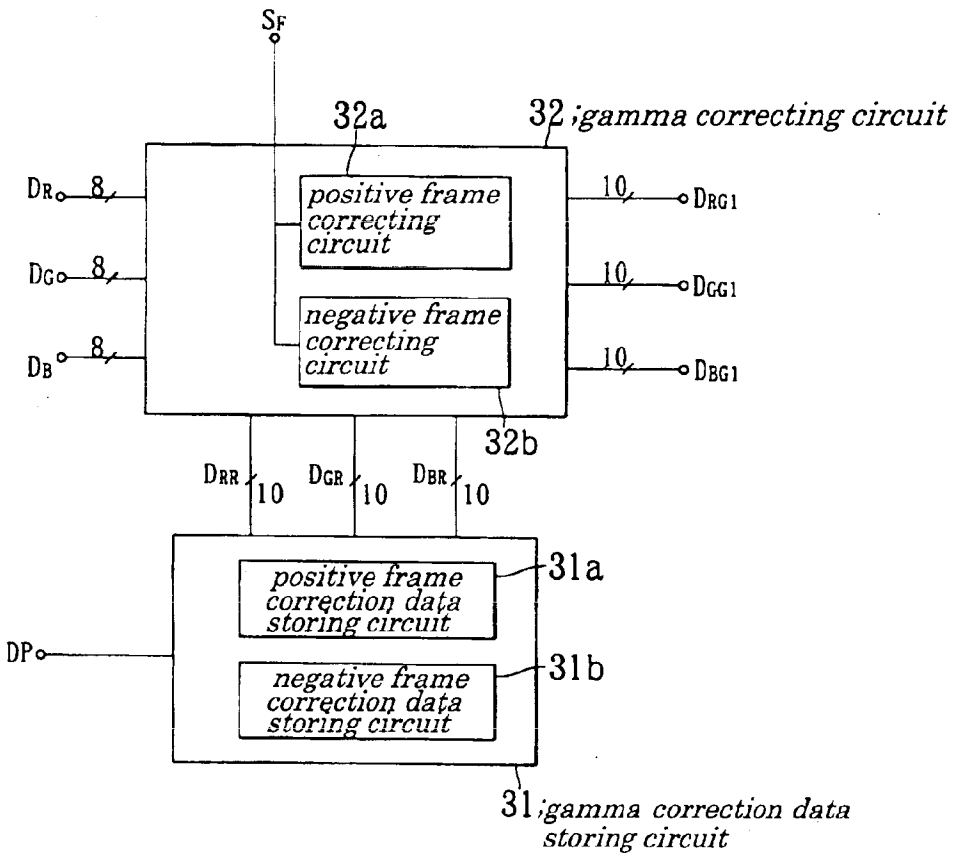
FIG. 8 is a schematic block diagram showing configurations of a gamma correction data storing circuit 31 and a gamma correcting circuit 32 making up the liquid crystal display device of the second embodiment of the present invention.

The gamma correction data storing circuit 31 is made up of semiconductor memories such as a ROM, RAM, or a non-volatile semiconductor memory including a flush EEPROM and, as shown in FIG. 8, has a positive frame correction data storing circuit 31*a* and a negative frame correction data storing circuit 31*b*. The gamma correction data storing circuit 31 stores, in advance, red corrected data $D_{RR}$, green corrected data $D_{GR}$, and blue corrected data $D_{BR}$ each being of 10 bits and being corresponded to 8 types of correcting patterns (Pattern 1 to Pattern 8) to be read during every positive frame and negative frame and feeds red corrected data $D_{RR}$, green corrected data $D_{GR}$, and blue corrected data $D_{BR}$ corresponding to a correcting pattern selected by corrected pattern selecting data DP of 3 bits to be fed from an external to the gamma correcting circuit 32. The red corrected data $D_{RR}$, green corrected data $D_{GR}$, and blue corrected data $D_{BR}$ each being of 10 bits and to be read during every positive frame and during every negative frame are used to prevent the degradation in linearity of a gamma characteristic occurring after the gamma correction has been made, as in case of the conventional method, to red data $D_R$, green data $D_G$, and blue data $D_B$ each being of 8 bits to convert them to corrected red data $D_{RG}$, corrected green data $D_{GG}$, and corrected blue data $D_{BG}$. Moreover, the red corrected data $D_{RR}$, green corrected data $D_{GR}$, and blue corrected data $D_{BR}$ each being of 10 bits and to be fed during the positive and negative frames are used for the gray-scale correction described above.

The 8 types of correcting patterns include, for example, a correcting pattern used to have an input image signal to be matched to a change in a gamma characteristic of a color liquid crystal display 1 corresponding to a variation in an ambient temperature of the liquid crystal display device, a correcting pattern used to have an input image signal be matched to a change in a gamma characteristic of the color liquid crystal display 1 corresponding to a variation in ambient illumination of the liquid crystal display device, a correcting pattern used to have an input image to be matched to a gamma characteristic of the color liquid crystal display 1 which changes depending on a frequency characteristic of a timing signal, a correcting pattern used to have an input image to be matched to a gamma characteristic of the color liquid crystal display 1 which changes depending on a variation in luminance of a backlight, a correcting pattern used to have an input image signal to be matched to dispersion in a gamma characteristic which occurs during a process of manufacturing the color liquid crystal display 1, or a like. The red corrected data $D_{RR}$, green corrected data $D_{GR}$, and blue corrected data $D_{BR}$ for every correcting pattern are made up of values used to measure, in advance, a gamma characteristic of the color liquid crystal display 1 obtained when ambient temperature or ambient illumination of the liquid crystal display device being in a mounted state, frequency characteristic of a timing signal, luminance of the backlight are changed or dispersion in a gamma characteristic occurring during a process of manufacturing the color liquid crystal display 1 and to remove influences caused by such the changes or dispersion in the gamma characteristic through the gamma correction. That is, the gamma correction of the embodiment includes the first gamma correction and second gamma correction described above.

Moreover, configurations of the gamma correction data storing circuit 31 are the same as those of the gamma correction data storing circuit 22 shown in FIG. 1 except that the positive frame correction data storing circuit 31*a* corresponding to positive frames and the negative frame correction data storing circuit 31*b* corresponding to negative frames are mounted and their descriptions are omitted accordingly.

Next, a method of calculating the above red corrected data $D_{RR}$, green corrected data $D_{GR}$, and blue corrected data $D_{BR}$ will be explained.

(1) First, as in case of the first embodiment described above, luminance that can be obtained when a data signal providing 0 to 255 gray levels is applied to the data electrode of the color liquid crystal display 1 is measured to calculate a gamma characteristic (see FIG. 3).

(2) Next, a common potential $V_{com}$ (which is called a "common potential $V_X$" to display a gray level "$n_x$" on the color liquid crystal display 1) used to display each halftone on the color liquid crystal display 1 is measured. Then, to make relative the common potential $V_X$, as shown by an equation (112), a difference between a common potential $V_{com}$ (which is called a common potential $V_{REF}$ used to display a reference gray shade on the color liquid crystal display 1) used to display a reference gray shade (in case of the liquid crystal display device of the embodiment adapted to display 256 gray levels, for example, 127 gray levels) and each of measured common potential $V_X$ is obtained as a direct current voltage $V_{DCx}$.

$$V_{DCx}=V_X-V_{REF} \quad \text{Equation (112)}$$

Figure 9:
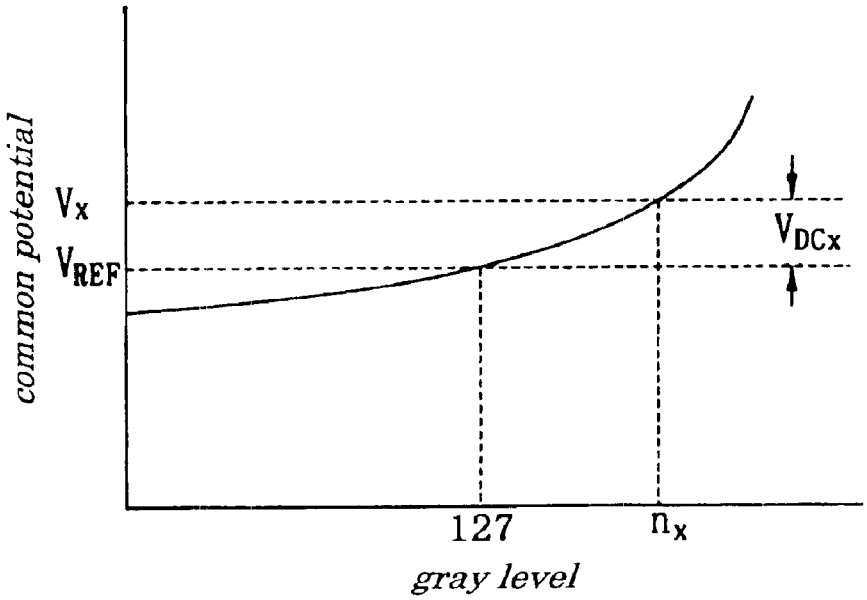
FIG. 9 is a diagram showing one example of a method of obtaining a direct current voltage $V_{DCx}$ in case of a reference gray scale being 127 gray levels employed in the second embodiment of the present invention.

FIG. 9 is a diagram showing one example of a method of obtaining the direct current voltage $V_{DCx}$ in case of the reference gray shade being 127 gray levels. Moreover, FIG. 9 shows as if the common potential $V_{com}$ changes according to a variation in gray levels, however, actually, a feedthrough component (direct current component) changes due to a variation in a capacity of a liquid crystal cell caused by a change in gray levels and the change in the feedthrough component is merely expressed as the change in the common potential $V_{com}$. The common potential $V_X$ shown in FIG. 9 is a potential obtained by measuring a value obtained when flickering occurring when each gray shade is displayed on a specified place (for example, in a center of the screen) on a screen of the color liquid crystal display 1 is minimized. Here, the common potential $V_X$ obtained when flickering is minimized denotes a value that can cancel both positive and negative components contained in the feedthrough component (direct current component) of the common potential $V_{com}$.

Figure 10:
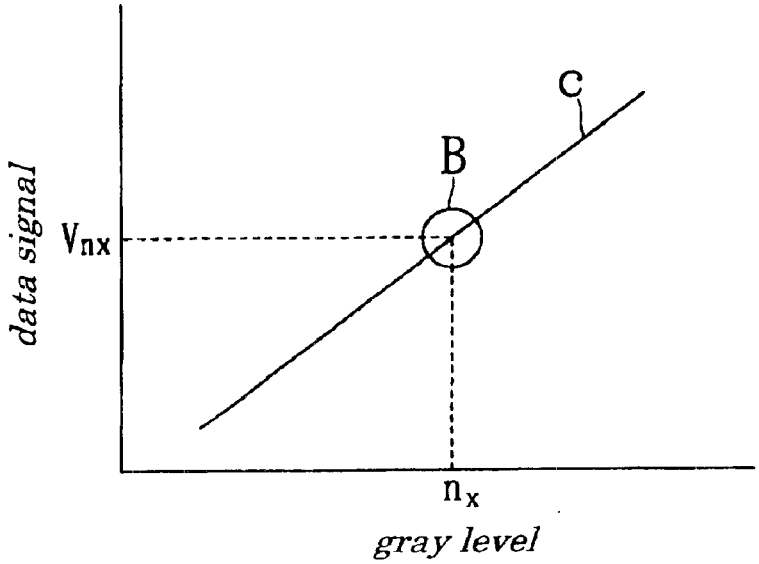
FIG. 10 is a diagram showing one example of a characteristic of a data signal for a gray scale employed in the second embodiment of the present invention.

(3) Next, a data signal $V_{nx}$ to be applied to a data electrode when a gray level "$n_1$" is displayed on the color liquid crystal display 1 is measured. FIG. 10 is a diagram showing one example of a characteristic of a data signal for a gray scale.

(4) Next, a gamma correction is made by a following method in order to have a gamma characteristic of the color liquid crystal display 1 be matched to a gamma characteristic of, for example, a CRT display, that is, in order to have normalized luminance in the gamma characteristic of the color liquid crystal display 1 become same as that in the gamma characteristic of the CRT display at a certain gray level. As shown in FIG. 3, in the curve "b" showing the gamma characteristic of the CRT display, when the gray level is "$n_0$", its normalized luminance is "$m_0$", while, in the curve "a" showing the gamma characteristic of the color liquid crystal display 1, a gray level to make its normalized luminance be "$m_0$" is "$n_1$". Therefore, when the gray level "$n_0$" is input, the gray level "$n_1$" is output. The gray level "$n_1$" is obtained by a following method.

(a) If a gray level obtained by making a gamma correction to the gray level "$n_0$" is an integer, the obtained gray level, as it is, is used as the gray level "$n_1$".

(b) If the gray level obtained by making a gamma correction to the gray level "$n_0$" is not an integer, a gray level obtained by substituting two gray levels "$n_a$" and "$n_b$" (see FIG. 4), being nearest to a gray level that can make the normalized luminance be "$m_0$" in the curve "a" showing the gamma characteristic of the color liquid crystal display 1 into an equation (101) is used as the gray scale "$n_1$":

$$n_1=(m_0+m_b\cdot n_a-m_a\cdot n_b)/(m_b-m_a) \quad \text{Equation (101)}$$

where "$m_a$" denotes normalized luminance that can be obtained when a gray level is "$n_a$" in the curve "a" showing the gamma characteristic of the color liquid crystal display 1 and "$m_b$" denotes normalized luminance that can be obtained when a gray level is "$n_b$" in the curve "a" showing the gamma characteristic of the color liquid crystal display 1. Moreover, a method for deriving the equation (101) is the same as in the first embodiment.

(c) No gamma correction is made in case of a minimum gray scale, that is, 0 gray levels and of a maximum gray scale, that is, 255 gray levels, and these gray scales, as they are, are used as the gray shades.

Next, when a gray level $n_1$ is displayed on the color liquid crystal display 1, if a data signal $|V_{n1+}|$ to be fed during a positive frame and a data signal $|V_{n1-}|$ to be fed during a negative frame are used as a data signal to be applied to a data electrode, an equation (113) is derived when a gray-scale correction is not made:

$$|V_{n1+}|=|V_{n1-}| \quad \text{Equation (113)}$$

Figure 11:
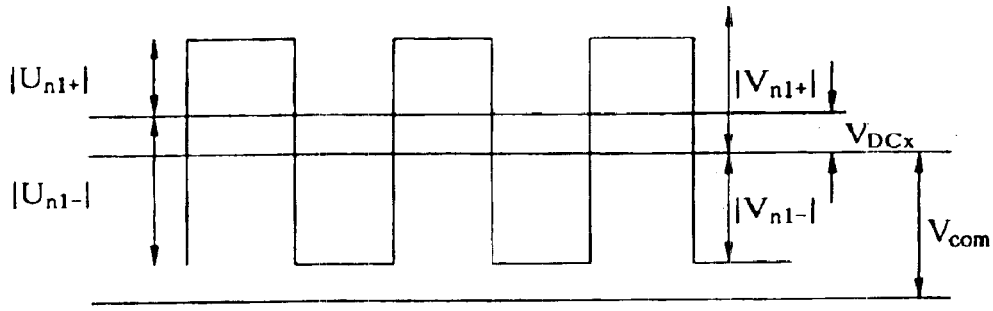
FIG. 11 is a diagram showing one example of a relation among $|V_{n1+}|$, $|V_{n1-}|$, $|U_{n1+}|$, and $|U_{n1-}|$, and a common potential $V_{com}$ employed in the second embodiment of the present invention.

Now, in the example shown in FIG. 9, the current voltage $V_{DCx}$ is used as a direct current when the gray level $n_x$ is displayed on the color liquid crystal display 1 and, when a gray-scale correction is made by using the current voltage $V_{DCx}$, if a data signal $|U_{n1+}|$ to be fed during a positive frame and a data signal $|U_{n1-}|$ to be fed during a negative frame are used as a data signal to be applied to the data electrode in the color liquid crystal display 1, following equations (114) and (115) are derived. FIG. 11 is a diagram showing one example of a relation among $|V_{n1+}|$, $|V_{n1-}|$, $|U_{n1+}|$, $|U_{n1-}|$, and a common potential $V_{com}$:

$$|U_{n1+}|=||V_{n1+}|-V_{DCx}| \quad \text{Equation (114)}$$

$$|U_{n1-}|=||V_{n1-}|+V_{DCx}| \quad \text{Equation (115)}$$

Now, a gray shade to be displayed on the color liquid crystal display 1 when the data signal $|U_{n1+}|$ to be fed during a positive frame is applied to a data electrode is defined as a gray level $n_{r+}$ and a gray shade to be displayed on the color liquid crystal display 1 when the data signal $|U_{n1-}|$ to be fed during a negative frame is applied to a data electrode is defined as a gray level $n_{r-}$. The gray levels "$n_{r+}$" and "$n_{r-}$" is obtained by a following method.

(d) If both the gray levels "$n_{r+}$" and "$n_{r-}$" are an integer, the obtained gray levels, as they are, are used as the gray levels.

Figure 12:
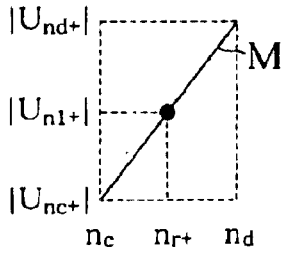
FIG. 12 is an enlarged diagram of a portion "B" in FIG. 10.

(e) If the gray levels "$n_{r+}$" and "$n_{r-}$" are not an integer, gray levels obtained by substituting two gray levels "$n_{c+}$" and "$n_{d+}$" (in case of the positive frame) or two gray levels "$n_{c-}$" and "$n_{d-}$" (in case of the negative frame) (FIG. 12 shows a case of the positive frame) which are nearest to gray levels that can provide a data signal $|U_{n1+}|$ and $|U_{n1-}|$ in the characteristic of the data signal for a gray scale of the color liquid crystal display 1, into equations (116) and (117), are used as the gray levels "$n_{r+}$" and "$n_{r-}$". FIG. 12 is an enlarged diagram of a portion "B" in FIG. 10. In FIG. 12, the straight line M is an approximate straight line of the curve "c" shown in FIG. 10:

$$n_{1+}=(|U_{n1+}|+|U_{nd+}|\cdot n_c-|U_{nc+}|\cdot n_d)/(|U_{nd+}|-|U_{nd+}|) \quad \text{Equation (116)}$$

where each of the "$|U_{nc+}|$" and "$|U_{nd+}|$" is a data signal used when each of the gray levels $n_c$ and $n_d$ to be provided during a positive frame is displayed in the characteristic of the data signal for a gray scale of the liquid crystal display 1:

$$n_{r-}=(|U_{n1-}|+|U_{nd-}|\cdot n_c-|U_{nc-}|\cdot n_d)/(|U_{nd-}|-|U_{nc-}|) \quad \text{Equation (117)}$$

where each of the "$|U_{nc-}|$" and "$|U_{nd-}|$" is a data signal used when each of the gray levels $n_c$ and $n_d$ to be provided during a negative frame is displayed in the characteristic of the data signal for a gray scale of the liquid crystal display 1. Moreover, the equations (116) and (117) can be obtained in the same way as is the case of the equation (101) employed in the first embodiment.

(f) No gamma correction is made in case of a minimum gray scale, that is, 0 gray levels and of a maximum gray scale, that is, 255 gray levels, and these gray scales, as they are, are used as the gray shade.

Next, by substituting the obtained gray levels $n_{r+}$ and $n_{r-}$ (decimal) being of 8 bits into equations (118) and (119), gray levels $n'_{r+}$ and $n'_{r-}$ (decimal) being of 10 bits are calculated:

$$n'_{r+}=INT(4\cdot n_{r+}+0.5) \quad \text{Equation (118)}$$

$$n'_{r-}=INT(4\cdot n_{r-}+0.5) \quad \text{Equation (119)}$$

where "INT ( )" represents that only an integral portion of a result from the arithmetic operations within the parentheses is used. By using calculation methods described above, red corrected data $D_{RR}$, green corrected data $D_{GR}$, and blue corrected data $D_{BR}$ for all correcting patterns are calculated.

The gamma correcting circuit 32 has a positive frame correcting circuit $\mathbf{32}_a$ and a negative frame correcting circuit $\mathbf{32}_b$. The positive frame correcting circuit $\mathbf{32}_a$ provides a gray scale by making a gamma correction to red data $D_R$, green data $D_G$, and blue data $D_B$ each being of 8 bits and to be fed during a positive frame from the digital video data storing circuit 21, based on a frame signal $S_F$ fed from the control circuit 33 and using red corrected data $D_R$, green corrected data $D_{GR}$, and blue corrected data $D_{BR}$ each being of 10 bits and to be fed during a positive frame from the positive frame correction data storing circuit $\mathbf{31}_a$ making up the gamma correction data storing circuit 31. Similarly, the negative frame correcting circuit $\mathbf{32}_b$ provides a gray scale by making a gamma correction to red data $D_R$, green data $D_G$, and blue data $D_{BR}$ each being of 8 bits and to be fed during a negative frame from the digital video data storing circuit 21, based on a frame signal $S_F$ fed from the control circuit 33 and using red corrected data $D_{RR}$, green corrected data $D_{GR}$, and blue corrected data $D_{BR}$ each being of 10 bits and to be fed during a negative frame from the negative frame correction data storing circuit $\mathbf{31}_b$ making up the gamma correction data storing circuit 31. Then, the gamma correcting circuit 32 feeds the results from the gamma correction to the FRC circuit 24 as first corrected red data $D_{RG1}$, first corrected green data $D_{GG1}$, and first corrected blue data $D_{BG1}$ each being of 10 bits. The gamma correction to be made by the gamma correcting circuit 32 includes first gamma correction and second gamma correction. The positive frame correcting circuit $\mathbf{32}_a$ makes a gamma correction, with timing when a frame signal $S_F$ is fed, based on red data $D_R$, green data $D_G$, and blue data $D_B$ each being of 8 bits and to be fed during a positive frame and by selecting red corrected data $D_{RR}$, green corrected data $D_{GR}$, and blue corrected data $D_{BR}$ each being 10 bits and to be fed during a positive frame corresponding to a correcting pattern selected by corrected pattern selecting data DP from the positive frame correction data storing circuit $\mathbf{31}_{a-}$. Similarly, the negative frame correcting circuit $\mathbf{32}_b$ makes a gamma correction, with timing when a frame signal $S_F$ is fed, based on red data $D_R$, green data $D_G$, and blue data $D_B$ each being of 8 bits and to be fed during a negative frame and by selecting red corrected data $D_{RR}$, green corrected data $D_{GR}$, and blue corrected data $D_{BR}$ each being 10 bits and to be fed during a negative frame corresponding to a correcting pattern selected by corrected pattern selecting data DP from the positive frame correction data storing circuit $\mathbf{31}_b$.

The control circuit 33 is made up of, for example, an ASIC. The control circuit 33, based on a horizontal sync signal $S_H$, vertical sync signal $S_V$, clock CLK, and a like fed from an external, generates a horizontal scanning pulse $P_H$, vertical scanning pulse $P_V$, frame signal $S_F$, and polarity reversing pulse POL and feeds them to the gamma correcting circuit 32, data electrode driving circuit 26, and scanning electrode driving circuit 5. The frame signal $S_F$ is a signal indicating a display period of one screen and a polarity of which is reversed on every screen which can be obtained by dividing a frequency of a vertical sync signal $S_V$ into halves.

Next, operations of the liquid crystal display device having configurations described above will be explained. First, when data "000" (binary) used to select Pattern 1 shown in FIG. 2 is fed as a corrected pattern selecting data DP from an external, red corrected data $D_{RR}$, green corrected data $D_{GR}$, and blue corrected data $D_{BR}$ each being of 10 bits and to be fed during a positive frame and during a negative frame corresponding to Pattern 1 are sequentially read from a storing region with addresses A12 to A0 being "0" to "767" (decimal) in the positive frame correction data storing circuit $\mathbf{31}_a$ and the negative frame correction data storing circuit $\mathbf{31}_b$ making up the gamma correction data storing circuit 31 and are then fed to the positive frame correcting circuit $\mathbf{32}_a$ and negative frame correcting circuit $\mathbf{32}_b$. The Pattern 1 is a correcting pattern used to have an input image be matched to a change in a gamma characteristic of a color liquid crystal display 1 corresponding to a variation in an ambient temperature of the liquid crystal display device.

Next, when digital video data made up of red data $D_R$, green data $D_G$, and blue data $D_B$ each being of 8 bits is fed from an external, the digital video data, after having been stored once in the digital video data storing circuit 21, is read and is then fed to the gamma correcting circuit 32. The positive frame correcting circuit $\mathbf{32}_a$ in the gamma correcting circuit 32 provides a gray scale by making a gamma correction, based on a frame signal $S_F$, to red data $D_R$, green data $D_G$, and blue data $D_B$ each being of 8 bits and to be fed during a positive frame fed from the digital video data storing circuit 21 using red corrected data $D_{RR}$, green corrected data $D_{GR}$, and blue corrected data $D_{BR}$ each being of 10 bits and to be fed during a positive frame fed from the positive frame correction data storing circuit $\mathbf{31}_a$. Similarly, the negative frame correcting circuit $\mathbf{32}_b$ in the gamma correcting circuit 32 provides a gray scale by making a gamma correction, based on a frame signal $S_F$, to red data $D_R$, green data $D_G$, and blue data $D_B$ each being of 8 bits and to be fed during a negative frame from the digital video data storing circuit 21 using red corrected data $D_{RR}$, green corrected data $D_{GR}$, and blue corrected data $D_{BR}$ each being of 10 bits and to be fed during a negative frame from the negative frame correction data storing circuit $\mathbf{31}_b$. Then, the gamma correcting circuit 32 feeds results from the gamma correction to the FRC circuit 24 as first corrected red data $D_{RG1}$, first corrected green data $D_{GG1}$, and first corrected blue data $D_{BG1}$ each being of 10 bits. Moreover, operations of the FRC circuit 24, data electrode driving circuit 26 and scanning electrode driving circuit 5 are the same as those in the first embodiment and their descriptions are omitted accordingly.

Thus, according to the second embodiment, in addition to operations employed in the first embodiment, the gamma correcting circuit 32 makes a gamma correction and a gray-scale correction to red data $D_R$, green data $D_G$, and blue data $D_B$ each being of 8 bits to be fed during a positive frame and a negative frame from an external to obtain first corrected red data $D_{RG1}$, first green corrected data $D_{GG1}$, and first corrected data $D_{BG1}$ each being of 10 bits. In other words, in the second embodiment, the gamma correction and the gray-scale correction are made based on contents being stored in the gamma correction data storing circuit 31, that is, on each value of luminance obtained when each gray shade is displayed on the color liquid crystal display 1, a value of a feedthrough component (direct current component) of a common potential $V_{com}$ for each gray scale of the color liquid crystal display 1, and on a value of a data signal to be applied to a data electrode when each gray shade is displayed. Therefore, according to the configuration of the embodiment, in addition to the effects obtained in the first embodiment, effects described below can be achieved.

That is, the conventional gray-scale correction is made by correcting a voltage of a data signal in the data electrode driving circuit and, therefore, circuit configurations of the data electrode driving circuit are made complicated and, if the data electrode driving circuit is configured using a semiconductor, a chip area is made large. Moreover, in semiconductor integrated circuits making up the data electrode driving circuit, in ordinary cases, a plurality of semiconductor integrated circuits has to be mounted to correspond to a plurality of data electrodes in the color liquid crystal display 1 and, therefore, the larger the screen, the larger the number of the data electrode driving circuits. Moreover, ordinarily, data electrode driving circuits are integrally incorporated in an LCD (Liquid Crystal Display) module together with the liquid crystal display 1, scanning electrode driving circuit, control circuit, and a like and, further, if the gray-scale correction is to be made by correcting a voltage of a data signal in the data electrode driving circuit, the configuration cannot meet recent requirements for savings in space in the liquid crystal display. In contrast, according to the configuration of the embodiment, since the gray-scale correction is made by the gamma correcting circuit 32, configurations of the data electrode driving circuit can be made simple and the chip area can be reduced. This enables the above configuration to fully meet recent requirements for savings in space in the liquid crystal display device.

Figure 13:
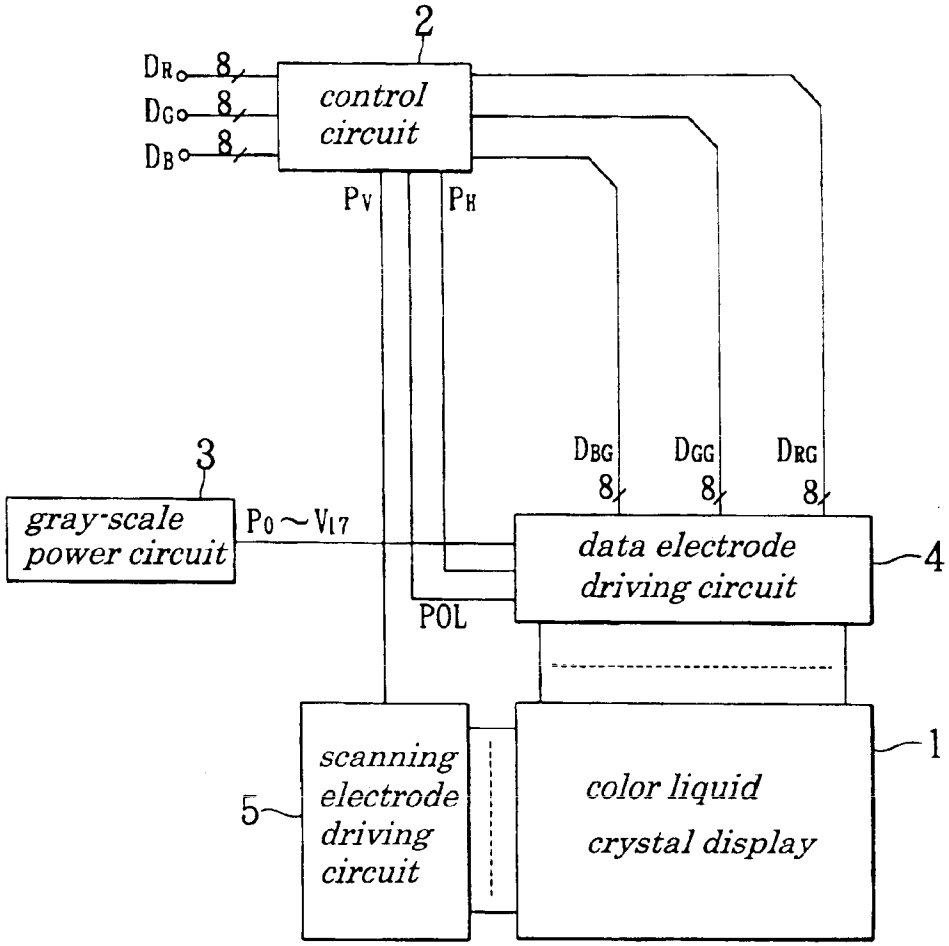
FIG.13(PRIOR ART)
FIG. 13 is a schematic block diagram showing an example of configurations of a conventional liquid crystal display device Japanese Patent Application Laid-open No. 2001-134242.
Figure 14:
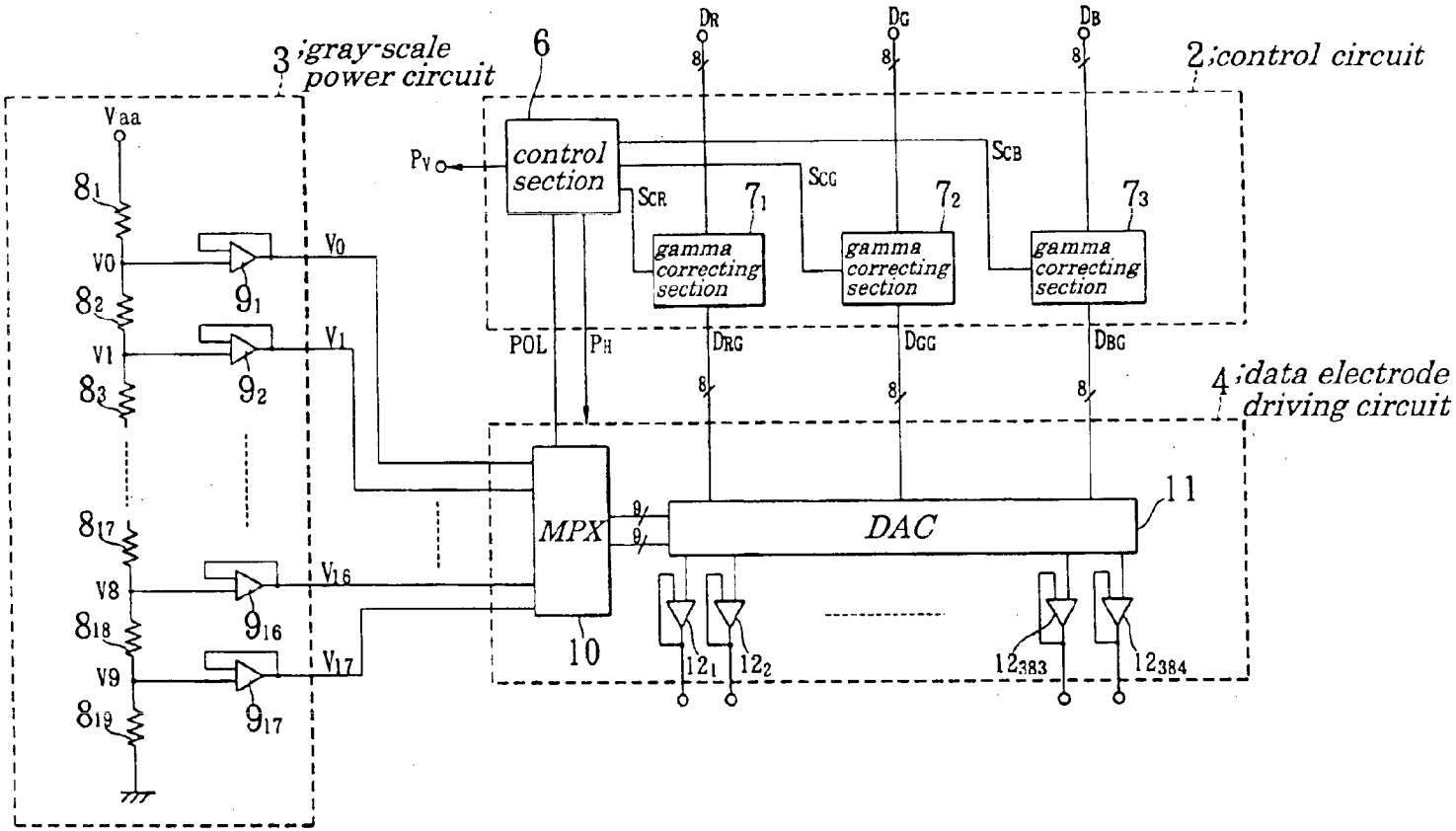
FIG.14(PRIOR ART)
FIG. 14 is a schematic block diagram showing configurations of a control circuit 2, gray-scale power circuit 3, and data electrode driving circuit 4, each making up the conventional liquid crystal display device.
Figure 15:
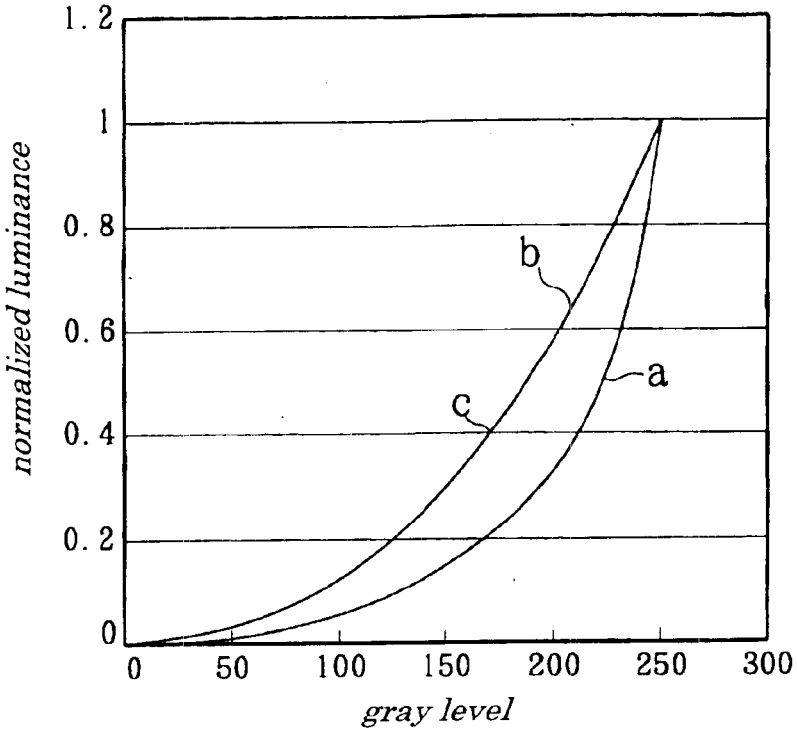
FIG.15(PRIOR ART)
FIG. 15 is a diagram showing one example of a gamma characteristic of a CRT display, a gamma characteristic of digital image data, and a gamma characteristic obtained when the latter is matched to the former.
Figure 16:
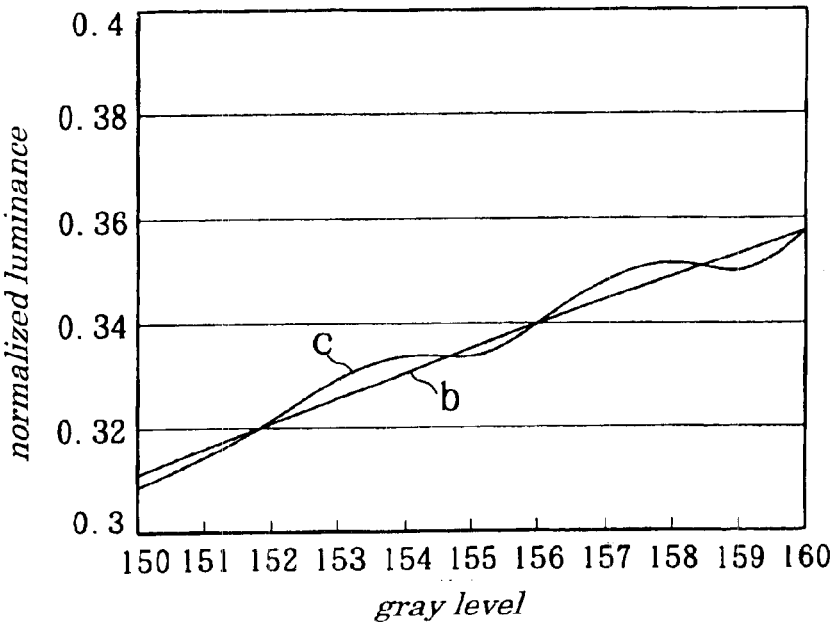
FIG.16(PRIOR ART)
FIG. 16 is an enlarged diagram showing a part of two curves shown in FIG. 15.
Figure 17:
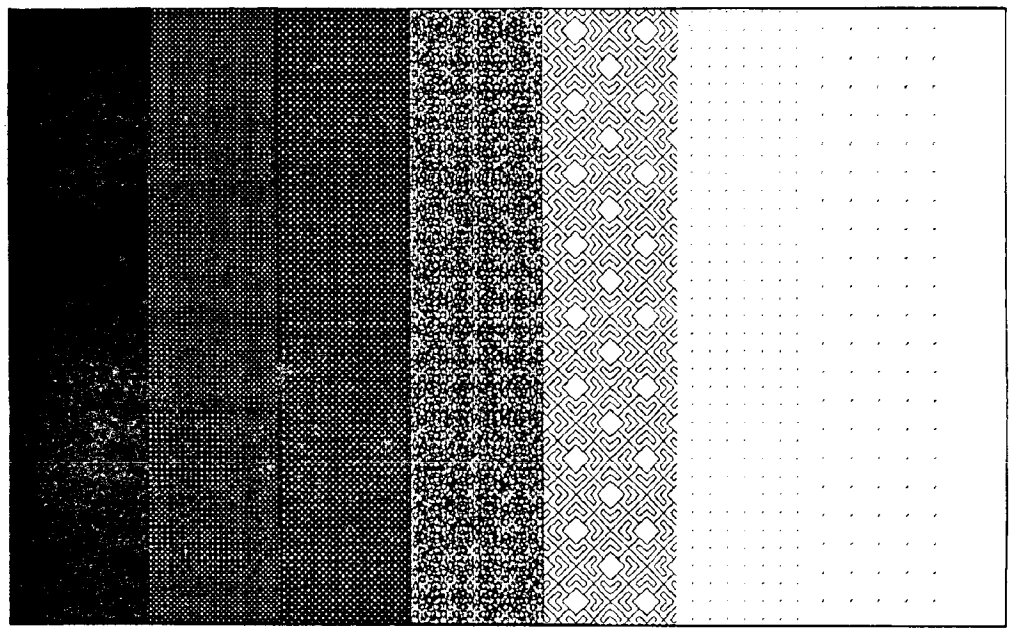
FIG. 17(PRIOR ART)
FIG. 17 is a diagram showing an example of display for a gray scale.

It is apparent that the present invention is not limited to the above embodiments but may be changed and modified without departing from the scope and spirit of the invention. For example, in each of the above embodiments, the first gamma correction and the second gamma correction are made by the gamma correcting circuits 23 and 32, however, the first gamma correction and the second gamma fine correction may be made by the gamma correcting circuits 23 and 32, and the second coarse correction may be made by the data electrode driving circuit 26. In this case, the gray-scale power circuit 3 shown in FIG. 13 is required and the data electrode driving circuit 26 has almost the same configuration as the data electrode driving circuit 4 shown in FIG. 14 has.

Moreover, in each of the above embodiments, 8 types of correcting patterns are stored, in advance, in the gamma correction data storing circuits 22 and 31, however, a number of the types of the correcting pattern may be more or less than "8". Also, in each of the above embodiments, red corrected data $D_{RR}$, green corrected data $D_{GR}$, and blue corrected data $D_{BR}$ are stored for every correcting pattern in the gamma correction data storing circuit 22 and 31, however, red data $D_R$, green data $D_G$, and blue data $D_B$ can be commonly stored as corrected data. This enables a storage capacity of the gamma correction data storing circuit 22 and 31 to be reduced and types of the correcting patterns to be increased with the storage capacity being unchanged. Also, in each of the above embodiments, the gamma correcting circuits 23 and 32 make a gamma correction using red corrected data $D_{RR}$, green corrected data $D_{GR}$, and blue corrected data $D_{BR}$ each being of 10 bits and being stored in advance in the gamma correction data storing circuits 22 and 31, however, the gamma correcting circuits 23 and 32 may make a gamma correction by, for example, arithmetic operations. Also, in the above embodiments, the gray level $n_1$ is obtained by the method shown as (a) to (c) in the above descriptions, however, it may be calculated by using other approximation methods. Also, in the above embodiments, the digital video data storing circuit 21 is mounted, however, digital video data may be directly fed to the gamma correcting circuits 23 and 32 without using the digital video data storing circuit 21. Moreover, in the above embodiments, the number of bits of red data $D_R$, green data $D_G$, and blue data $D_B$ making up digital video data is "8", and the gamma correction is made to these data by the gamma correcting circuits 23 and 32 to convert to first corrected red data $D_{RG1}$, first corrected green data $D_{GG1}$, and first corrected blue data $D_{BG1}$ each being 10 bits, however, the number of bits of the red data $D_R$, green data $D_G$, and blue data $D_B$ may be, for example, "6" and the number of bits of the first corrected red data $D_{RG1}$, first corrected green data $D_{GG1}$, and first corrected blue data $D_{BG1}$ may be, for example, "8".

Also, the present invention may be applied not only to the color liquid crystal display but also to a monochrome liquid crystal display. Furthermore, the liquid crystal display device employing the present invention can be applied to a monitor for personal computers, TV sets, or a like and, in this case, the monitor has, in addition to the liquid crystal display device having configurations described above, an analog to digital converter (DAC) adapted to convert an analog video signal to a digital video signal, a timing controller adapted to generate a variety of timing signals based on a horizontal sync signal $S_H$ and vertical sync signal $S_V$ fed from an external and a scaling circuit adapted to match a resolution of digital video data having various resolutions output from the DAC to a resolution of the color liquid crystal display.

What is claimed is:

1. A method for driving a liquid crystal display, comprising:

obtaining gamma correcting data to which information used to change the gray scale of received digital video data a plurality of times has been added when a gamma correction is made to the digital video data; and expressing a number of gray scales, larger than a number of gray scales expressed by the digital video data, by performing frame rate control in such a manner that a data signal used to change, based on the gamma correcting data, the gray scale a plurality of times for the digital video data is produced, and the produced data signal is sequentially fed to a data electrode in a liquid crystal display unit, wherein the gamma correcting data is obtained from a gray scale calculated by an approximation using two gray levels that are nearest to a gray level that provides desired luminance in a gamma characteristic of the liquid crystal display unit.

2. The method for driving a liquid crystal display according to claim 1, wherein, said the gamma correcting data has been obtained in advance and has been stored in a storage medium and read for the digital video data.

3. A method for driving a liquid crystal display, comprising:

obtaining gamma correcting data to which information used to chance the gray scale of received digital video data a plurality of times has been added when a gamma correction is made to the digital video data; and expressing a number of gray scales, larger than a number of gray scales expressed by the digital video data, by performing frame rate control in such a manner that a data signal used to change, based on the gamma correcting data, the gray scale a plurality of times for the digital video data is produced, and the produced data signal is sequentially fed to a data electrode in a liquid crystal display unit, wherein the gamma correcting data is obtained by measuring luminance to be obtained when a data signal providing a minimum gray level to a maximum gray level is fed to the data electrode in the liquid crystal display unit to calculate a gamma characteristic of the liquid crystal display unit, and, in order to have the gamma characteristic matched to a desired gamma characteristic, if the gray scale obtained by making a gamma correction to a gray level $n_0$ is an integer, employing the obtained gray scale as a new gray level $n_1$, and, if a gray scale obtained by making the gamma correction to the gray level $n_0$ is not an integer, employing a gray scale obtained by substituting two gray levels $n_a$ and $n_b$ that are nearest to a gray level that provides desired luminance in a gamma characteristic of the liquid crystal display unit into an equation $n_1=(m_0+m_b \cdot n_a-m_a \cdot n_b)/(m_b-m_a)$, as said new gray level $n_1$, and, if said gray level $n_0$ is a minimum gray level or a maximum gray level, employing the gray level $n_0$ as the new gray level $n_1$ without making the gamma correction, where "$m_o$" denotes luminance that can be obtained when the gray level is "$n_o$" in the gamma characteristic of said color liquid crystal display unit, "$m_a$" denotes luminance that can be obtained when the gray level is "$n_a$" in the gamma characteristic of said color liquid crystal display unit, and "$m_b$" denotes luminance that can be obtained when the gray level is "$n_b$" in the gamma characteristic of said color liquid crystal display unit.

4. The method for driving a liquid crystal display according to claim 3, wherein the gamma correcting data has been obtained in advance and has been stored in a storage medium and read for the digital video data.

5. A method for driving a liquid crystal display, comprising:

obtaining gamma correcting data to which information used to change the gray scale of received digital video data a plurality of times has been added when a gamma correction is made to the digital video data; and expressing a number of gray scales, larger than a number of gray scales expressed by the digital video data, by performing frame rate control in such a manner that a data signal used to change, based on the gamma correcting data, the gray scale a plurality of times for the digital video data is produced, and the produced data signal is sequentially fed to a data electrode in a liquid crystal display unit, wherein:

a gray-scale correction has been made to the obtained gamma correcting data to make different a voltage of the data signal depending on whether the data signal is fed during a positive frame or during a negative frame while halftones are provided, and the gamma correcting data is obtained from a gray scale calculated by an approximation using two gray levels that are nearest to a gray level that provides desired luminance in a gamma characteristic of said liquid crystal display unit.

6. The method for driving a liquid crystal display according to claim 5, wherein the gamma correcting data has been obtained in advance and has been stored in a storage medium and read for the digital video data.

7. The method for driving a liquid crystal display according to claim 5, wherein the gamma correcting data is obtained by measuring luminance to be obtained when a data signal providing a minimum gray level to a maximum gray level is fed to the data electrode in the liquid crystal display unit to calculate a gamma characteristic of the liquid crystal display unit, measuring a common potential $V_X$ to be used when each halftone $n_x$ is displayed on the liquid crystal display unit, calculating a difference, as a current voltage $V_{DCX}$, between a common potential $V_{REF}$ to be used when a gray scale serving as a reference is displayed on the liquid crystal display unit and the measured common potential $V_X$, obtained by measuring a data signal $V_{nx}$ to be fed to the data electrode when the halftone $n_x$ is displayed on the liquid crystal display unit, and, in order to have the gamma characteristic matched to a desired gamma characteristic, if the gray scale obtained by making the gamma correction to a gray level $n_0$ is an integer, employing the obtained gray scale as a new gray level $n_1$ and, if the gray scale obtained by making the gamma correction to the gray level $n_0$ is not an integer, employing a gray scale obtained by substituting two gray levels $n_a$ and $n_b$ that are nearest to a gray scale that provides desired luminance in a gamma characteristic of the liquid crystal display unit into an equation $n_1=(m_0+m_b \cdot n_a-m_a \cdot n_b)/(m_b-m_a)$, as the new gray scale $n_1$ and, in case of a minimum gray level or a maximum gray level, employing the gray level $n_0$ as the new gray scale $n_1$, and, when the equations $|U_{n1+}|=||V_{n1+}|-V_{DCx}|$ and $U_{n1-}|=||V_{n1-}|+V_{DCx}|$ are derived between a data signal $|V_{n1+}|$ to be fed during a positive frame and a data signal $|V_{n1-}|$ to be fed during a negative frame that are applied to the data electrode when the gray level $n_1$ is displayed on the liquid crystal display unit without making a gray-scale correction and a data signal $|U_{n1+}|$ to be fed during a positive frame and data signal $|U_{n1-}|$ to be fed during a negative frame that are applied to the data electrode when the gray level $n_X$ is displayed on the liquid crystal display unit by making a gray-scale correction, and in case of using a gray scale to be displayed on the liquid crystal display unit when a data signal $|U_{n1+}|$ to be fed during a positive frame is applied to the data electrode, as a gray level $n_{r+}$, and using a gray scale to be displayed on the liquid crystal display unit when a data signal $|U_{n1-}|$ to be fed during a negative frame is applied to the data electrode, as a gray level $n_{r-}$, if the gray level $n_{r+}$ and gray level $n_{r-}$ are integers and are a minimum level or a maximum level, employing the gray level $n_{r+}$ and gray level $n_{r-}$ as a gray scale, and, if the gray level $n_{r+}$ and gray level $n_{r-}$ are not integers, employing gray levels obtained by substituting two gray levels $n_{c+}$ and $n_{d+}$ to be fed during a positive frame and two gray levels $n_{c-}$ and $n_{d-}$ to be fed during a negative frame that are nearest to gray levels that provide the data signal $|U_{n1+}|$ and $|U_{n1-}|$ in a characteristic of the data signal for a gray scale of the liquid crystal display unit into the equations $n_{r+}=(|U_{n1+}|+|U_{nd+}| \cdot n_c-|U_{nc+}| \cdot n_d)/(|U_{nd+}|-|U_{nc+}|)$ and $n_{r-}=(|U_{n1-}|+|U_{nd-}| \cdot n_c-|U_{nc-}| \cdot n_d)/(|U_{nd-}|-|U_{nc-}|)$, as gray level $n_{r+}$ and gray level $n_{r-1}$ where "$m_o$" denotes luminance that can be obtained when the gray level is "$_o$" in the gamma characteristic of said color liquid crystal display unit, "$m_a$" denotes luminance that can be obtained when a gray level is "$n_a$" in a gamma characteristic of said color liquid crystal display unit, and "$m_b$" denotes luminance that can be obtained when the gray level is "$n_b$" in the gamma characteristic of said color liquid crystal display unit, where each of "$|U_{nc+}|$" and "$|U_{nd+}|$" comprises a data signal used when each of the gray levels $n_c$ and $n_d$ to be fed during a positive frame is displayed in the characteristic of the data signal for a gray scale of the liquid crystal display unit, and where each of "$|U_{nc-}|$" and "$|U_{nd-}|$" comprises a data signal used when each of the gray levels $n_c$ and $n_d$ to be provided during a negative frame is displayed in the characteristic of the data signal for a gray scale of the liquid crystal display unit.

8. The method for driving a liquid crystal display according to claim 7, wherein the correcting data has been obtained in advance and has been stored in a storage medium and read for the digital video data.

9. A method for driving a liquid crystal display, comprising:

obtaining gamma correcting data to which information used to change the gray scale of received digital video data a plurality of times has been added when a gamma correction is made to the digital video data; and expressing a number of gray scales, larger than a number of gray scales expressed by the digital video data, by performing frame rate control in such a manner that a data signal used to change, based on the gamma correcting data, the gray scale a plurality of times for the digital video data is produced, and the produced data signal is sequentially fed to a data electrode in a liquid crystal display unit, wherein the gamma correction comprises obtaining correspondence to a change in a gamma characteristic of the liquid crystal display unit caused by any one or more of a variation in ambient temperature, a variation in ambient illumination, a frequency characteristic of the data, a variation in luminance of a backlight used to provide light to the liquid crystal display unit from its rear surface, and dispersion in a gamma characteristic occurring during a process of manufacturing the liquid crystal display unit.

10. A method for driving a liquid crystal display, comprising:

obtaining gamma correcting data to which information used to change a gray scale a plurality of times for received digital video data has been added when a gamma correction is made to the digital video data; and expressing a number of gray scales, larger than a number of gray scales expressed by the digital video data, by performing frame rate control in such a manner that a data signal used to change, based on the gamma correcting data, a gray scale a plurality of times for the digital video data is produced, and the produced data signal is sequentially fed to a data electrode in a liquid crystal display unit, wherein the digital video data comprises red data, green data, and blue data and the gamma correction is made independently to each of the red data, green data, and blue data, and the gamma correction comprises a first gamma correction segment to be made to the red data, green data, and blue data to arbitrarily provide a characteristic of luminance of a reproduced image corresponding to luminance of an input image, and a second gamma correction segment to match an input image signal to a transmittance characteristic of each of the applied voltages for a red color, a green color, and a blue color in the liquid crystal display unit.

11. The method for driving a liquid crystal display according to claim 10, wherein the information comprises data used to select a pattern to change the gray scale a plurality of times for the gamma correcting data.

12. A liquid crystal display device, comprising:

a liquid crystal display unit;

a gamma correcting circuit to obtain gamma correcting data to which information used to change a gray scale of received digital video data a plurality of times has been added when a gamma correction is made to the digital video data;

a data signal producing circuit to express a number of gray scales larger than a number of gray scales expressed by the digital video data by performing frame rate control in such a manner that a data signal used to change, based on the gamma correcting data, the gray scale a plurality of times for the digital video data is produced, and the produced data signal is sequentially fed to a data electrode in said liquid crystal display unit, wherein said gamma correcting circuit obtains the gamma correcting data from a gray scale calculated by an approximation using two gray levels that are nearest to a gray level that provides desired luminance in a gamma characteristic of said liquid crystal display unit.

13. A liquid crystal display device, comprising:

a liquid crystal display unit;

a gamma correcting circuit to obtain gamma correcting data to which information used to change a gray scale of received digital video data a plurality of times has been added when a gamma correction is made to the digital video data;

a data signal producing circuit to express a number of gray scales larger than a number of gray scales expressed by the digital video data by performing frame rate control in such a manner that a data signal used to change, based on the gamma correcting data, the gray scale a plurality of times for the digital video data is produced, and the produced data signal is sequentially fed to a data electrode in said liquid crystal display unit; and a corrected data storing circuit in which is stored the gamma correcting data which is obtained from a gray scale calculated by an approximation using two gray levels that are nearest to a gray level that provides desired luminance in a gamma characteristic of said liquid crystal display unit, wherein said gamma correcting circuit reads the gamma correcting data from said corrected data storing circuit for the received digital video data and feeds the read data to said data signal producing circuit.

14. The liquid crystal display device according to claim 13, wherein said corrected data storing circuit stores, in advance, gamma correcting data on a gamma correction to be used for obtaining correspondence to a change in a gamma characteristic of said liquid crystal display unit caused by any one or more of a variation in ambient temperature, a variation in ambient illumination, a frequency characteristic of the data, a variation in luminance of a backlight used to provide light to said liquid crystal display unit from its rear surface, and dispersion in a gamma characteristic occurring during a process of manufacturing said liquid crystal display unit, and feeds gamma correcting data selected by correction pattern selecting data to be fed from an external source to said gamma correcting circuit, and wherein said gamma correcting circuit reads the gamma correcting data from the corrected data storing circuit for the digital video data and supplies the read data to said data signal producing circuit.

15. A liquid crystal display device, comprising:

a liquid crystal display unit;

a gamma correcting circuit to obtain gamma correcting data to which information used to change a gray scale of received digital video data a plurality of times has been added when a gamma correction is made to the digital video data; and a data signal producing circuit to express a number of gray scales larger than a number of gray scales expressed by the digital video data by performing frame rate control in such a manner that a data signal used to change, based on the gamma correcting data, the gray scale a plurality of times for the digital video data is produced, and the produced data signal is sequentially fed to a data electrode in said liquid crystal display unit, wherein said gamma correcting circuit obtains the gamma correcting data by measuring luminance to be obtained when a data signal providing a minimum gray level to a maximum gray level is fed to said data electrode in said liquid crystal display unit to calculate a gamma characteristic of said liquid crystal display unit, in order to have the gamma characteristic be matched to a desired gamma characteristic, and if the gray scale obtained by making a gamma correction to a gray level $n_0$ is an integer, by employing the obtained gray scale as a new gray level $n_1$, and, if a gray scale obtained by making a gamma correction to the gray level $n_0$ is not an integer, by employing a gray scale obtained by substituting two gray levels $n_a$ and $n_b$, that are nearest to a gray level that provides desired luminance in a gamma characteristic of said liquid crystal display unit, into an equation $n_1=(m_0+m_b \cdot n_a-m_a \cdot n_b)/(m_b-m_a)$, as the new gray level $n_1$, and, if the gray level $n_0$ is a minimum gray level or a maximum gray level, employing the gray level $n_0$ as the new gray level $n_1$ without making a gamma correction, where "$m_o$" denotes luminance that can be obtained when the gray level is "$n_o$" in the gamma characteristic of said color liquid crystal display unit, "$m_a$" denotes luminance that can be obtained when the gray level is "$n_a$" in a gamma characteristic of said color liquid crystal display unit, and "$m_b$" denotes luminance that can be obtained when the gray level is "$n_b$" in the gamma characteristic of said color liquid crystal display unit.

16. A liquid crystal display device, comprising:

a liquid crystal display unit;

a gamma correcting circuit to obtain gamma correcting data to which information used to change a gray scale of received digital video data a plurality of times has been added when a gamma correction is made to the digital video data;

a data signal producing circuit to express a number of gray scales larger than a number of gray scales expressed by the digital video data by performing frame rate control in such a manner that a data signal used to change, based on the gamma correcting data, the gray scale a plurality of times for the digital video data is produced, and the produced data signal is sequentially fed to a data electrode in said liquid crystal display unit; and a corrected data storing circuit for storing, in advance, the gamma correcting data obtained by measuring luminance to be obtained when a data signal providing a minimum gray level to a maximum gray level is fed to said data electrode in said liquid crystal display unit to calculate a gamma characteristic of said liquid crystal display unit, in order to have the gamma characteristic be matched to a desired gamma characteristic, and if the gray scale obtained by making a gamma correction to a gray level $n_0$ is an integer, by employing the obtained gray scale as a new gray level $n_1$, and, if a gray scale obtained by making a gamma correction to the gray level $n_0$ is not an integer, by employing a gray scale obtained by substituting two gray levels $n_a$ and $n_b$ that are nearest to a gray level that provides desired luminance in a gamma characteristic of said liquid crystal display unit into an equation $n_1=(m_0+m_b \cdot n_a-m_a \cdot n_b)/(m_b-m_a)$, as the new gray level $n_1$ and, if the gray level $n_0$ is a minimum gray level or a maximum gray level, employing the gray level $n_0$ as the new gray level $n_1$ without making a gamma correction, wherein said gamma correcting circuit reads the gamma correcting data from said corrected data storing circuit for the received digital video data and feeds the read data to the data signal producing circuit, where "$m_o$" denotes luminance that can be obtained when the gray level is "$n_o$" in the gamma characteristic of said color liquid crystal display unit, "$m_a$" denotes luminance that can be obtained when the gray level is "$n_a$" in the gamma characteristic of said color liquid crystal display unit, and "$m_b$" denotes luminance that can be obtained when the gray level is "$n_b$" in the gamma characteristic of said color liquid crystal display unit.

17. A liquid crystal display device, comprising:

a liquid crystal display unit;

a gamma correcting circuit to obtain gamma correcting data to which information used to change a gray scale of received digital video data a plurality of times has been added when a gamma correction is made to the digital video data; and a data signal producing circuit to express a number of gray scales larger than a number of gray scales expressed by the digital video data by performing frame rate control in such a manner that a data signal used to change, based on the gamma correcting data, the gray scale a plurality of times for the digital video data is produced, and the produced data signal is sequentially fed to a data electrode in said liquid crystal display unit, wherein:

said gamma correcting circuit obtains gamma correcting data to which information used to change a gray scale a plurality of times for the digital video data has been added when a gamma correction is made to the digital video data and to which a gray-scale correction has been made to make different a voltage of the data signal depending on whether the data signal is fed during a positive frame or during a negative frame while half-tones are provided, and said gamma correcting circuit obtains the gamma correcting data from a gray scale calculated by an approximation using two gray levels that are nearest to a gray level that provides desired luminance in a gamma characteristic of said liquid crystal display unit.

18. The liquid crystal display device according to claim 17, further comprising a corrected data storing circuit in which is stored the gamma correcting data which is obtained from a gray scale calculated by an approximation using two gray levels that are nearest to a gray level that provides desired luminance in a gamma characteristic of said liquid crystal display unit, and wherein said gamma correcting circuit reads the gamma correcting data from said corrected data storing circuit for the received digital video data and feeds the read data to said data signal producing circuit.

19. The liquid crystal display device according to claim 17, wherein said gamma correcting circuit obtains the gamma correcting data by measuring luminance to be obtained when a data signal providing a minimum gray level to a maximum gray level is fed to said data electrode in said liquid crystal display unit to calculate a gamma characteristic of said liquid crystal display unit, by measuring a common potential $V_X$ to be used when each halftone $n_X$ is displayed on said liquid crystal display unit and by calculating a difference, as a current voltage $V_{DCX}$, between a common potential $V_{REF}$ to be used when a gray scale serving as a reference is displayed on said liquid crystal display unit and the measured common potential $V_X$, by measuring a data signal $V_{nx}$ to be fed to said data electrode when the halftone $n_X$ is displayed on said liquid crystal display unit, in order to have the gamma characteristic matched to a desired gamma characteristic, if the gray scale obtained by making the gamma correction to a gray level $n_0$ is an integer, by employing the obtained gray scale as a new gray level $n_1$ and, if the gray scale obtained by making the gamma correction to the gray level $n_0$ is not an integer, by employing a gray scale obtained by substituting two gray levels $n_a$ and $n_b$ that are nearest to a gray scale that provides desired luminance in a gamma characteristic of said liquid crystal display unit into an equation $n_1=(m_0+m_b\cdot n_a-m_a\cdot n_b)/(m_b-m_a)$ as the new gray scale $n_1$ and, in case of a minimum gray level or a maximum gray level, by employing the gray level $n_0$ as the new gray scale $n_1$ and, when the equations $|U_{n1+}|=||V_{n1+}|-V_{DCx}|$ and $|U_{n1-}|=||V_{n1-}|+V_{DCx}|$ are derived between a data signal $|V_{n1+}|$ to be fed during a positive frame and data signal $|V_{n1-}|$ to be fed during a negative frame that are applied to said data electrode when the gray level $n_1$ is displayed on said liquid crystal display unit without making a gray-scale correction and a data signal $|U_{n1+}|$ to be fed during a positive frame and a data signal $|U_{n1-}|$ to be fed during a negative frame that are applied to said data electrode when said gray level $n_X$ is displayed on said liquid crystal display unit by making a gray scale correction and in case of using a gray scale to be displayed on said liquid crystal display unit when the data signal $|U_{n1+}|$ to be fed during a positive frame is applied to said data electrode, as a gray level $n_{r+}$, and using a gray scale to be displayed on said liquid crystal display unit when the data signal $|U_{n1-}|$ to be fed during a negative frame is applied to said data electrode, as a gray level $n_{r-}$, if the gray level $n_{r+}$ and gray level $n_{r-}$ are integers and are a minimum level or a maximum level, by employing the gray level $n_{r+}$ and gray level $n_{r-}$ as a gray scale and, if the gray level $n_{r+}$ and gray level $n_{r-}$ are not integers, by employing gray levels obtained by substituting two gray levels $n_{c+}$ and $n_{d+}$ to be fed during a positive frame and two gray levels $n_{c-}$ and $n_{d-}$ to be fed during a negative frame that are nearest to gray levels that provide the data signals $|U_{n1+}|$ and $|U_{n1-}|$ in a characteristic of the data signal for a gray scale of said liquid crystal display into the equations $n_{r+}=(|U_{n1+}|+|U_{nd+}|\cdot n_c-|U_{nc+}|\cdot n_d)/(|U_{nd+}|-|U_{nc+}|)$ and $n_{r-}=(|U_{n1-|+|Und-}|\cdot n_c-|U_{nc-}|\cdot n_d)/(|U_{nd-}|-|U_{nc-}|)$, as gray level $n_{r+}$ and gray level $n_{r-}$, and wherein said gamma correcting circuit reads the gamma correcting data from said corrected data storing circuit for the digital video data and feeds the read data to said data signal producing circuit, where "$m_o$" denotes luminance that can be obtained when the gray level is "$n_o$" in the gamma characteristic of said color liquid crystal display unit, "$m_a$" denotes luminance that can be obtained when the gray level is "$n_a$" in the gamma characteristic of said color liquid crystal display unit, and "$m_b$" denotes luminance that can be obtained when the gray level is "$n_b$" in the gamma characteristic of said color liquid crystal display unit, where each of "$|U_{nc+}|$" and "$|U_{nd+}|$" is a data signal used when each of the gray levels $n_c$ and $n_d$ to be fed during a positive frame is displayed in the characteristic of the data signal for the gray scale of said liquid crystal display unit, and where each of "$|U_{nc-}|$" and "$|U_{nd-}|$" is a data signal used when each of the gray levels $n_c$ and $n_d$ to be provided during a negative frame is displayed in the characteristic of the data signal for the gray scale of said liquid crystal display unit.

20. A liquid crystal display device, comprising:

a liquid crystal display unit;

a gamma correcting circuit to obtain gamma correcting data to which information used to change a gray scale of received digital video data a plurality of times has been added when a gamma correction is made to the digital video data; and a data signal producing circuit to express a number of gray scales larger than a number of gray scales expressed by the digital video data by performing frame rate control in such a manner that a data signal used to change, based on the gamma correcting data, the gray scale a plurality of times for the digital video data is produced, and the produced data signal is sequentially fed to a data electrode in said liquid crystal display unit, wherein:

said gamma correcting circuit obtains gamma correcting data to which information used to change a gray scale a plurality of times for the digital video data has been added when a gamma correction is made to the digital video data and to which a gray-scale correction has been made to make different a voltage of the data signal depending on whether the data signal is fed during a positive frame or during a negative frame while halftones are provided, wherein said gamma correcting circuit obtains the gamma correcting data by measuring luminance to be obtained when a data signal providing a minimum gray level to a maximum gray level is fed to said data electrode in said liquid crystal display unit to calculate a gamma characteristic of said liquid crystal display unit, by measuring a common potential $V_X$ to be used when each halftone $n_X$ is displayed on said liquid crystal display unit and by calculating a difference, as a current voltage $V_{DCX}$, between a common potential $V_{REF}$ to be used when a gray scale serving as a reference is displayed on said liquid crystal display unit and the measured common potential $V_X$, by measuring a data signal $V_{nx}$ to be fed to said data electrode when the halftone $n_X$ is displayed on said liquid crystal display unit and, in order to have the gamma characteristic matched to a desired gamma characteristic, if the gray scale obtained by making the gamma correction to a gray level $n_0$ is an integer, by employing the obtained gray scale as a new gray level $n_1$ and, if a gray scale obtained by making a gamma correction to the gray level $n_0$ is not an integer, by employing a gray scale obtained by substituting two gray levels $n_a$ and $n_b$ that are nearest to a gray scale that provides desired luminance in a gamma characteristic of said liquid crystal display unit into an equation $n_1=(m_0+m_b \cdot n_a-m_a \cdot n_b)/(m_b-m_a)$, as the new gray scale $n_1$ and, in case of a minimum gray level or a maximum gray level, by employing the gray level $n_o$ as the new gray scale $n_1$ and, when the equations $|U_{n1+}|=||V_{n1+}|-V_{DCx_}|$ and $|U_{n1-}|=||V_{n1-}|+V_{DCx_}|$ are derived between a data signal $|V_{n1+}|$ to be fed during a positive frame and data signal $|V_{n1-}|$ to be fed during a negative frame that are applied to said data electrode when the gray level $n_1$ is displayed on said liquid crystal display unit without making a gray-scale correction and a data signal $|U_{n1+}|$ to be fed during a positive frame and data signal $|U_{n1-}|$ to be fed during a negative frame that are applied to said data electrode when the gray level $n_X$ is displayed on said liquid crystal display unit by making a gray-scale correction and in case of using a gray scale to be displayed on said liquid crystal display unit when a data signal $|U_{n1+}|$ to be fed during a positive frame is applied to said data electrode, as a gray level $n_{r+}$, and using a gray scale to be displayed on said liquid crystal display unit when a data signal $|U_{n1-}|$ to be fed during a negative frame is applied to said data electrode, as a gray level $n_{r-}$, if the gray level $n_{r+}$ and gray level $n_{r-}$ are integers and are a minimum level or a maximum level, by employing the gray level $n_{r+}$ and gray level $n_{r-}$ as a gray scale and, if the gray level $n_{r+}$ and gray level $n_{r-}$ are not integers, by employing gray levels obtained by substituting two gray levels $n_{c+}$ and $n_{d+}$ to be fed during a positive frame and two gray levels $n_{c-}$ and $n_{d-}$ to be fed during a negative frame that are nearest to gray levels that provide the data signals $|U_{n1+}|$ and $|U_{n1-}|$ in a characteristic of the data signal for a gray scale of said liquid crystal display unit into the equations $n_{r+}=(|U_{n1+}|+|U_{nd+}| \cdot n_c-|U_{nc+}| \cdot n_d)/(|U_{nd+}|-|U_{nc+}|$ and $n_{r-}=(|U_{n1-|+|Und-}| \cdot n_c-|U_{nc-}| \cdot n_d)/(|U_{nd-}|-|U_{nc-}|)$, as gray level $n_{r+}$ and gray level $n_{r-}$, where "$m_o$" denotes luminance that can be obtained when the gray level is "$n_o$" in the gamma characteristic of said color liquid crystal display unit. "$m_a$" denotes luminance that can be obtained when the gray level is "$n_a$" in the gamma characteristic of said color liquid crystal display unit, and "$m_b$" denotes luminance that can be obtained when the gray level is "$n_b$" in the gamma characteristic of said color liquid crystal display unit, where each of "$|U_{nc+}|$" and "$|U_{nd+}|$" is a data signal used when each of the gray levels $n_c$ and $n_d$ for a positive frame is displayed in the characteristic of the data signal for a gray scale of said liquid crystal display unit, and where each of "$|U_{nc-}|$" and "$|U_{nd-}|$" is a data signal used when each of the gray levels $n_c$ and $n_d$ to be provided during a negative frame is displayed in the characteristic of the data signal for the gray scale of said liquid crystal display unit.

21. A liquid crystal display device, comprising:

a liquid crystal display unit;

a gamma correcting circuit to obtain gamma correcting data to which information used to change a gray scale of received digital video data a plurality of times has been added when a gamma correction is made to the digital video data; and a data signal producing circuit to express a number of gray scales larger than a number of gray scales expressed by the digital video data by performing frame rate control in such a manner that a data signal used to change, based on the gamma correcting data, the gray scale a plurality of times for the digital video data is produced, and the produced data signal is sequentially fed to a data electrode in said liquid crystal display unit, wherein:

the digital video data includes red data, green data, and blue data, and the gamma correction is made independently to each of the red data, green data, and blue data, and the gamma correction includes a first gamma correction segment to be made to the red data, green data, and blue data to arbitrarily provide a characteristic of luminance of a reproduced image corresponding to luminance of an input image, and a second gamma correction segment to match an input image signal to a transmittance characteristic of each of the applied voltages for a red color, a green color, and a blue color in said liquid crystal display unit.

22. The liquid crystal display device according to claim 21, wherein the information is data used to select a pattern to change the gray scale a plurality of times for the gamma correcting data.

* * * * *